US010227548B2

(12) United States Patent
Zhang et al.

(10) Patent No.: US 10,227,548 B2
(45) Date of Patent: Mar. 12, 2019

(54) COMPOSITION COMPRISING A QUAT, CATIONIC POLYSACCHARIDE, AND A MIXTURE OF NONIONIC POLYSACCHARIDES

(71) Applicant: RHODIA OPERATIONS, Paris (FR)

(72) Inventors: Hai Zhou Zhang, Shanghai (CN); Lin He, Singapore (SG); Da Wei Jin, Singapore (SG); Nikolay Christov, Singapore (SG); Galder Cristobal, Singapore (SG)

( * ) Notice: Subject to any disclaimer, the term of this patent is extended or adjusted under 35 U.S.C. 154(b) by 0 days.

(21) Appl. No.: 16/062,495

(22) PCT Filed: Dec. 15, 2016

(86) PCT No.: PCT/CN2016/110012
§ 371 (c)(1),
(2) Date: Jun. 14, 2018

(87) PCT Pub. No.: WO2017/101798
PCT Pub. Date: Jun. 22, 2017

(65) Prior Publication Data

US 2018/0371361 A1 Dec. 27, 2018

(30) Foreign Application Priority Data

Dec. 15, 2015 (WO) ..... PCT/CN2015/097357

(51) Int. Cl.

| | |
|---|---|
| ***C11D 3/22*** | (2006.01) |
| ***C11D 1/62*** | (2006.01) |
| ***C11D 3/50*** | (2006.01) |
| ***C11D 3/00*** | (2006.01) |
| *C11D 11/00* | (2006.01) |

(52) U.S. Cl.
CPC ..... *C11D 1/62* (2013.01); *C11D 3/0015* (2013.01); *C11D 3/227* (2013.01); *C11D 3/50* (2013.01); *C11D 11/0017* (2013.01)

(58) Field of Classification Search
CPC .. C11D 1/62; C11D 3/227; C11D 3/50; C11D 3/0015; C11D 11/0017
See application file for complete search history.

(56) References Cited

U.S. PATENT DOCUMENTS

| | | | | |
|---|---|---|---|---|
| 2,954,347 | A | 9/1960 | St. John et al. | |
| 3,455,839 | A | 7/1969 | Rauner | |
| 3,933,672 | A | 1/1976 | Bartolotta et al. | |
| 4,131,576 | A | 12/1978 | Iovine et al. | |
| 4,265,779 | A | 5/1981 | Gandolfo et al. | |
| 4,386,213 | A | 5/1983 | Giesecke et al. | |
| 4,652,392 | A | 3/1987 | Baginski et al. | |
| 4,798,679 | A | 1/1989 | Castro et al. | |
| 4,985,170 | A | 1/1991 | Dawson et al. | |
| 5,733,854 | A | 3/1998 | Chowdhary et al. | |
| 6,063,754 | A | 5/2000 | Ness | |
| 6,492,322 | B1 | 12/2002 | Cooper | |
| 2004/0120914 | A1 | 6/2004 | Decoster et al. | |
| 2011/0054042 | A1* | 3/2011 | Wu | A01N 25/04 514/772.4 |
| 2015/0197708 | A1* | 7/2015 | Jin | C11D 1/62 510/515 |

FOREIGN PATENT DOCUMENTS

| | | | |
|---|---|---|---|
| AU | 14416/88 | A | 10/1988 |
| DE | 4021265 | A1 | 1/1992 |
| EP | 0018039 | A1 | 10/1980 |
| EP | 150872 | A1 | 8/1985 |
| EP | 343840 | A2 | 11/1989 |
| EP | 0354016 | A | 2/1990 |
| FR | 1492597 | A | 8/1967 |
| WO | 2004032887 | * | 4/2004 |
| WO | 2004032887 | A1 | 4/2004 |
| WO | 2006055787 | A1 | 5/2006 |
| WO | 2006094580 | A1 | 9/2006 |
| WO | 2006094582 | A1 | 9/2006 |
| WO | 2010078959 | A1 | 7/2010 |
| WO | 2013189010 | A1 | 12/2013 |
| WO | 2014020147 | A2 | 2/2014 |
| WO | 2015107155 | A1 | 7/2015 |
| WO | 2015192975 | A1 | 12/2015 |
| WO | 2016102527 | A1 | 6/2016 |

OTHER PUBLICATIONS

K. L. Hodges, W. E. Kester, D. L. Wiederrich, J.A. Grover, Determination of Alkoxyl Substitution in Cellulose Ethers by Zeisel-Gas Chromatography, Nov. 1979, vol. 51, No. 13, Analytical Chemistry.

Kirk-Othmer, Encyclopedia of Chemical Technology, 1979, pp. 430-447, vol. 7, Third Edition, John Wiley & Sons, Inc.

Hand Book of Food Additives, an International Guide to More than 7,000 Products by Trade Name, Chemical, Function, and Manufacturer, Compiled by Michael and Irene Ash, 1995, pp. 803-805, ISBN 0-566-07592-X.

* cited by examiner

*Primary Examiner* — Charles I Boyer
(74) *Attorney, Agent, or Firm* — Jarrod N. Raphael

(57) ABSTRACT

Provided is a composition, notably a fabric conditioning composition, comprising (a) a quaternary ammonium compound; (b) a cationic polysaccharide; (c) a first non-ionic polysaccharide; and (d) a second non-ionic polysaccharide, wherein the second non-ionic polysaccharide is different from the first non-ionic polysaccharide and the second non-ionic polysaccharide has a Molar Substitution (MS) in the range of 0.2 to 1.8.

23 Claims, No Drawings

COMPOSITION COMPRISING A QUAT, CATIONIC POLYSACCHARIDE, AND A MIXTURE OF NONIONIC POLYSACCHARIDES

This application claims priority to PCT International Patent Application No. PCT/CN2015/097357 filed on Dec. 15, 2015, the whole content of this application being incorporated herein by reference for all purposes.

TECHNICAL FIELD

The present invention relates to a composition, in particular, a fabric conditioning composition, comprising a quaternary ammonium compound, a cationic polysaccharide and non-ionic polysaccharides. The present invention also relates to a method of use of the composition, in particular, a method for rinsing fabrics, which are previously laundered with a detergent, by using the composition.

BACKGROUND ART

The following discussion of the prior art is provided to place the invention in an appropriate technical context and enable the advantages of it to be more fully understood. It should be appreciated, however, that any discussion of the prior art throughout the specification should not be considered as an express or implied admission that such prior art is widely known or forms part of common general knowledge in the field.

Fabric conditioning compositions can be added in the rinse cycle of the laundering process to soften fabrics and to impart them nice smell. Conventionally, fabric conditioning systems are based on quaternary ammonium compounds, also named as quats, notably cetrimonium chloride, behentrimonium chloride, N,N-bis(stearoyl-oxy-ethyl) N,N-dimethyl ammonium chloride, N,N bis(tallowoyl-oxy-ethyl) N,N-dimethyl ammonium chloride, N,N bis(stearoyl-oxy-ethyl) N-(2-hydroxyethyl)N-methyl ammonium methylsulfate or 1,2-di(stearoyl-oxy)-3-trimethyl ammoniumpropane chloride. Advantageously, ester quats can be used as fabric conditioning actives. Ester quats are bio-degradable and exhibit lower eco toxicity, and therefore, there is a trend in the industry to use ester quats as the fabric conditioning actives.

It is highly desirable that the fabric conditioning compositions can have good conditioning performance combined with excellent stability. Fabric conditioning compositions with poor stability may become unpourable and have inadequate dispensing and dissolving characteristics in rinse water. This is in particular a problem when the fabric conditioning actives are present at high concentrations which may be required for achieving good conditioning performance. One option to solve this problem is to lower the dosage level of the quats in the composition by replacing some of the quats with a cationic polymer, such as a cationic polysaccharide. The art teaches that addition of cationic polymers to fabric conditioning compositions has a variety of benefits. U.S. Pat. No. 6,492,322, Megan et al., discloses fabric softening compositions comprising biodegradable diester softening compounds and cationic polymers including polysaccharides, such as gums, starches and certain cationic synthetic polymers.

However, replacing the quats with a cationic polysaccharide in the fabric conditioning compositions will lead to another problem. More specifically, the quats and the cationic polysaccharide, when combined, tend to separate. As a result, compositions comprising such components are no longer homogeneous and segregate into different phases. This is in particular an issue when these compounds are combined in an aqueous composition. This may pose problems to the user upon usage or may affect retailers when placing products on the shelves, without mentioning any associated loss of performance for the softening products.

Thus, it remains a challenge to provide a fabric conditioning composition having excellent softening performance combined with good stability. It remains a challenge to provide a fabric conditioning composition which can have long shelf life and which can remain stable and homogenous for extended time. In particular, it remains a challenge to provide a fabric conditioning composition with good stability without jeopardizing the dispersibility of the composition in aqueous solutions.

Laundry operation in which a fabric conditioning composition is used usually involves washing fabrics with a detergent composition, such as a detergent liquor, removing majority of the detergent composition, and subsequently treating the fabrics with a rinse solution containing the fabric conditioning composition. Such use of the fabric conditioning composition in conjunction with the detergent composition has certain problems. In particular, fabric conditioning actives, which are unusually cationic in nature, may interact with laundry residues carried over to the rinse solution from the washing step. Such laundry residues notably include anionic surfactants which are commonly used in detergent compositions. The interaction between the fabric conditioning actives and the carry-over laundry residues may result in a reduced conditioning effect, such as a reduced softening effect. The interaction may also lead to presence of poorly soluble flocs in the rinse solution which causes troubles to consumers. Such problems are particularly evident when the ratio of detergent to water is high in the washing step which may be required for achieving satisfactory cleaning effects. One way to solve these problems is to rinse and spin the fabrics repeatedly before bringing the fabrics to the rinse solution so as to remove most of the laundry residues. However, this will require high water consumption and prolonged time for the laundry operation.

Thus, aside from the stability problems mentioned above, it also remains a challenge to provide a composition which has excellent fabric softening effects when being used in conjunction with high dosage detergent that is added in the washing step. It remains a challenge to provide a method for rinsing fabrics which allows excellent conditioning effects even in the presence of laundry residues and which is time saving and cost efficient.

SUMMARY OF INVENTION

It has been found that the above problems can be solved by the present invention.

In a first aspect of the present invention, there is provided a composition comprising (a) a quaternary ammonium compound; (b) a cationic polysaccharide; (c) a first non-ionic polysaccharide; and (d) a second non-ionic polysaccharide, wherein the second non-ionic polysaccharide is different from the first non-ionic polysaccharide and the second non-ionic polysaccharide has a Molar Substitution (MS) in the range of 0.2 to 1.8.

The quaternary ammonium compound may have the general formula:

$$[N^+(R_1)(R_2)(R_3)(R_4)]_yX^- \quad (I)$$

wherein:

$R_1$, $R_2$, $R_3$ and $R_4$, which may be the same or different, is a $C_1$-$C_{30}$ hydrocarbon group, respectively, X is an anion;

y is the valence of X.

Notably, at least one of $R_1$, $R_2$, $R_3$ and $R_4$ as defined in general formula (I) contains an ester or amide group.

The quaternary ammonium compound may have the general formula:

$$[N^+((CH_2)_n\text{-}T\text{-}R_8)_m(R_9)_{4-m}]_yX^- \quad \text{(III)}$$

wherein:

$R_8$ group is independently selected from $C_1$-$C_{24}$ alkyl or alkenyl group;

$R_9$ group is independently selected from $C_1$-$C_4$ alkyl or hydroxylalkyl group;

T is —C(═O)—O—, —O—C(═O)—, —$NR_{10}$—C(═O)— or —(C═O)—$NR_{10}$—, wherein $R_{10}$ is hydrogen, a $C_1$-$C_6$ alkyl or a $C_1$-$C_6$ hydroxyalkyl group;

n is an integer from 0 to 5;

m is selected from 1, 2 and 3;

X is an anion;

y is the valence of X.

The quaternary ammonium compound may have the general formula:

$$[N^+((CH_2)_n\text{-}T\text{-}R_8)_2(R_9)_2]_yX^- \quad \text{(IV)}$$

wherein $R_8$ group is independently selected from $C_1$-$C_{24}$ alkyl or alkenyl group;

$R_9$ group is independently selected from $C_1$-$C_4$ alkyl or hydroxylalkyl group;

T is —C(═O)—O—, —O—C(═O)—, —$NR_{10}$—C(═O)— or —(C═O)—$NR_{10}$—, wherein $R_{10}$ is hydrogen, a $C_1$-$C_6$ alkyl or a $C_1$-$C_6$ hydroxyalkyl group;

n is an integer from 0 to 5;

X is an anion;

y is the valence of X.

The quaternary ammonium compound may be selected from the group consisting of:

TET: Di(tallowcarboxyethyl)hydroxyethyl methyl ammonium methylsulfate,

TEO: Di(oleocarboxyethyl)hydroxyethyl methyl ammonium methylsulfate,

TES: Distearyl hydroxyethyl methyl ammonium methylsulfate,

TEHT: Di(hydrogenated tallow-carboxyethyl)hydroxyethyl methyl ammonium methylsulfate, TEP: Di(palmiticcarboxyethyl)hydroxyethyl methyl ammonium methylsulfate, DEEDMAC: Dimethylbis[2-[(1-oxooctadecyl)oxy]ethyl] ammonium chloride.

The cationic polysaccharide may preferably be a cationic guar.

The first non-ionic polysaccharide may preferably be a non-ionic guar.

In some embodiments, the second non-ionic polysaccharide has a MS in the range of 0.4 to 1.0.

In some embodiments, the second non-ionic polysaccharide has a MS in the range of 0.5 to 1.8.

The second non-ionic polysaccharide preferably has an average molecular weight of between 1,500,000 Daltons and 3,000,000 Daltons.

The ratio between the weight of the quaternary ammonium compound and the total weight of the polysaccharides comprised in the composition may preferably be between 2:1 and 100:1.

The quaternary ammonium compound may be present in an amount of from 2 to 8 wt % based on the total weight of the composition.

The quaternary ammonium compound may preferably be present in an amount of from 2.5 to 4.5 wt % based on the total weight of the composition.

The composition may further comprise a fragrance material or perfume.

The composition may comprise from 0.3 to 5 wt % of the fragrance material or perfume based on the total weight of the composition.

The composition may comprise (a) from 0.5 wt % to 10 wt % of the quaternary ammonium compound; (b) from 0.05 wt % to 10 wt % of the cationic polysaccharide; (c) from 0.05 wt % to 10 wt % of the first non-ionic polysaccharide; (d) from 0.05 wt % to 10 wt % of the second non-ionic polysaccharide and (f) a liquid carrier, weight percentages are based on the total weight of the composition.

The composition is notably a fabric conditioning composition.

In a second aspect of the present invention, there is provided a method for conditioning a fabric by using the composition according to the first aspect of the present invention.

The method may comprise the step of contacting an aqueous medium comprising the composition according to the first aspect of the present invention with the fabric.

In a third aspect of the present invention, there is provided a use of the composition according to the first aspect of the present invention as a textile care agent.

In a fourth aspect of the present invention, there is provided a method for enhancing fragrance or perfume longevity of a composition by adding to the composition (a) a quaternary ammonium compound; (b) a cationic polysaccharide; (c) a first non-ionic polysaccharide; (d) a second non-ionic polysaccharide; and (e) a fragrance material or perfume, wherein the second non-ionic polysaccharide is different from the first non-ionic polysaccharide and the second non-ionic polysaccharide has a Molar Substitution (MS) in the range of 0.2 to 1.8.

In a fifth aspect of the present invention, there is provided a method for rinsing fabrics, said method comprising the step of contacting the fabrics, previously laundered with a detergent composition, with the composition according to the first aspect of the present invention; wherein the fabrics are contacted with said composition in a first rinse.

In a sixth aspect of the present invention, there is provided a method for reducing water consumption in a laundry operation in which a fabric conditioning composition is utilized, said method comprising the steps of:

(1) washing fabrics with a detergent composition;

(2) removing a major portion of the detergent composition; and (3) rinsing the fabrics in a first rinse in which the fabrics are contacted with the composition according to the first aspect of the present invention.

Other advantages and more specific properties of the composition according to the present invention will be clear after reading the following description of the invention.

DETAILED DESCRIPTION

Throughout the description, including the claims, the term "comprising one" or "comprising a" should be understood as being synonymous with the term "comprising at least one", unless otherwise specified, and "between" should be understood as being inclusive of the limits.

It should be noted that in specifying any range of concentration, weight ratio or amount, any particular upper concentration, weight ratio or amount can be associated with any particular lower concentration, weight ratio or amount, respectively.

In the context of this invention, "textile care agent" is understood to mean both washing and cleaning agents and pre-treatment agents, as well as agents for conditioning textile fabrics such as delicate fabric washing agents, and post-treatment agents such as conditioners.

In the context of this invention, the term "fabric conditioning" is used herein the broadest sense to include any conditioning benefit(s) to textile fabrics, materials, yarns, and woven fabrics. One such conditioning benefit is softening fabrics. Other non-limiting conditioning benefits include fabric lubrication, fabric relaxation, durable press, wrinkle resistance, wrinkle reduction, ease of ironing, abrasion resistance, fabric smoothing, anti-felting, anti-pilling, crispness, appearance enhancement, appearance rejuvenation, color protection, color rejuvenation, anti-shrinkage, in-wear shape retention, fabric elasticity, fabric tensile strength, fabric tear strength, static reduction, water absorbency or repellency, stain repellency; refreshing, anti-microbial, odor resistance; perfume freshness, perfume longevity, and mixtures thereof.

"Alkyl" as used herein means a straight chain or branched saturated aliphatic hydrocarbon group and is intended to include both "unsubstituted alkyl" and "substituted alkyl", the latter of which refers to alkyl moieties having substituents (such as halogen group) replacing a hydrogen on one or more carbon atoms of the alkyl group. "Alkenyl", as used herein, refers to an aliphatic group containing at least one double bond and is intended to include both "unsubstituted alkenyls" and "substituted alkenyls", the latter of which refers to alkenyl moieties having substituents (such as halogen group) replacing a hydrogen on one or more carbon atoms of the alkenyl group.

The term "cationic polymer" as used herein means any polymer which has a cationic charge.

The term "quaternary ammonium compound" (also referred to as "quat") as used herein means a compound containing at least one quaternized nitrogen wherein the nitrogen atom is attached to four organic groups. The quaternary ammonium compound may comprise one or more quaternized nitrogen atoms.

The term "cationic polysaccharide" as used herein means a polysaccharide or a derivative thereof that has been chemically modified to provide the polysaccharide or the derivative thereof with a net positive charge in a pH neutral aqueous medium. The cationic polysaccharide may also include those that are non permanently charged, e.g. a derivative that can be cationic below a given pH and neutral above that pH. Non-modified polysaccharides, such as starch, cellulose, pectin, carageenan, guars, xanthans, dextrans, curdlans, chitosan, chitin, and the like, can be chemically modified to impart cationic charges thereon. A common chemical modification incorporates quaternary ammonium substituents to the polysaccharide backbones. Other suitable cationic substituents include primary, secondary or tertiary amino groups or quaternary sulfonium or phosphinium groups. Additional chemical modifications may include cross-linking, stabilization reactions (such as alkylation and esterification), phophorylations, hydrolyzations.

The term "non-ionic polysaccharide" as used herein refers to a polysaccharide or a derivative thereof that has been chemically modified to provide the polysaccharide or the derivative thereof with a net neutral charge in a pH neutral aqueous medium; or a non-modified polysaccharide.

The term "first rinse", as used herein, means a step of rinsing fabrics which is conducted subsequent to the laundering of the fabrics, without any additional rinsing of the fabrics in between. The first rinse may be a rinsing cycle of an automated or non-automated washing machine. Alternatively, the first rinse may be a hand rinsing process subsequent to the laundering of the fabrics.

The term "rinse solution", as used herein, means a solution, notably an aqueous solution, used to rinse fabrics after the fabrics have been laundered. The rinse solution may be used in an automated or non-automated washing machine, or in the case of hand washing, may be used in a simple container, such as a basin or bucket.

The term "laundry residue", as used herein, means any material that may be present either on fabrics or in the detergent liquid during the wash cycle of the laundry operation and that is carried over with laundered fabrics to the rinse solution. Thus, "laundry residue" includes but is not limited to, residual soils, particulate matter, detergent surfactants, detergent builders, bleaching agents, metal ions, lipids, enzymes and any other materials that may have been present in the wash cycle solution. Furthermore, excess wash cycle solutions may be squeezed, wrung, or spun out of fabrics to remove excess laundry residue, prior to adding the fabrics to the rinse solution. However, such laundry residue is not completely removed (i.e., rinsed out of the fabrics with water) prior to adding the fabrics to the rinse solution. Preferably, laundry residue includes "surfactant residue", which means a surfactant material that may be present either on the fabrics or in the detergent liquid during the wash cycle of the laundry process and that is carried over with the laundered fabrics into the rinse solution.

In one aspect, the present invention relates to a composition comprising (a) a quaternary ammonium compound; (b) a cationic polysaccharide; (c) a first non-ionic polysaccharide; and (d) a second non-ionic polysaccharide, wherein the second non-ionic polysaccharide is different from the first non-ionic polysaccharide and the second non-ionic polysaccharide has a Molar Substitution (MS) in the range of 0.2 to 1.8.

The composition of the present invention is notably a fabric conditioning composition, in particular, an aqueous fabric conditioning composition. It is appreciated that the composition may also be other home care composition, such as a laundry composition, and a personal care composition, such as a hair conditioning composition, a shampoo and a body care composition.

In accordance to the present invention, some proportion of the quaternary ammonium compound in the composition could be reduced, by substitution with the cationic polysaccharide and the non-ionic polysaccharides without any negative effect on softening performance of the composition. While not wishing to be bound by theory, it is believed that the combination of the quaternary ammonium compound, the cationic polysaccharide and the nonionic polysaccharides could provide synergistic effect in enhancing the softening performance.

Quaternary Ammonium Compound

According to the present invention, the quaternary ammonium compound may have the general formula (I):

$$[N^+(R_1)(R_2)(R_3)(R_4)]_yX^- \quad (I)$$

wherein:

$R_1$, $R_2$, $R_3$ and $R_4$, which may be the same or different, is a $C_1$-$C_{30}$ hydrocarbon group, respectively, typically an alkyl, hydroxyalkyl or ethoxylated alkyl group, optionally containing a heteroatom or an ester or amide group;

X is an anion, for example halide, such as Cl or Br, sulphate, alkyl sulphate, nitrate or acetate;

y is the valence of X.

In some aspects, the quaternary ammonium compound is an alkyl quat, such as a di-alkyl quat.

The quat may notably be a compound of general formula (II):

$$[N^+(R_5)_2(R_6)(R_7)]_yX^- \quad (II)$$

wherein:

$R_5$ is an aliphatic $C_{16-22}$ group;

$R_6$ is a $C_1$-$C_4$ alkyl or hydroxyalkyl group;

$R_7$ is $R_5$ or $R_6$;

X is an anion, for example halide, such as Cl or Br, sulphate, alkyl sulphate, nitrate or acetate;

y is the valence of X.

The quat is preferably dihydrogenated tallow dimethyl ammonium chloride.

In some aspects, at least one of $R_1$, $R_2$, $R_3$ and $R_4$ as defined in general formula (I) contains an ester or amide group. Accordingly, the quaternary ammonium compound is an ester quat such as a di-alkyl di-ester quat.

The quat may have the general formula (III):

$$[N^+((CH_2)_n\text{-}T\text{-}R_8)_m(R_9)_{4-m}]_yX^- \quad (III)$$

wherein:

$R_8$ group is independently selected from $C_1$-$C_{24}$ alkyl or alkenyl group;

$R_9$ group is independently selected from $C_1$-$C_4$ alkyl or hydroxylalkyl group;

T is —C(═O)—O—, —O—C(═O)—, —$NR_{10}$—C(═O)— or —(C═O)—$NR_{10}$—, wherein $R_{10}$ is hydrogen, a $C_1$-$C_6$ alkyl or a $C_1$-$C_6$ hydroxyalkyl group;

n is an integer from 0 to 5;

m is selected from 1, 2 and 3;

X is an anion, for example a chloride, bromide, nitrate or methosulphate ion;

y is the valence of X.

In one exemplary embodiment, T as defined in general formula (III) is —C(═O)—O— or —O—C(═O)—.

Preferably, m as defined in general formula (III) is 2. Accordingly, the quaternary ammonium compound may have the general formula of (IV):

$$[N^+((CH_2)_n\text{-}T\text{-}R_8)_2(R_9)_2]_yX^- \quad (IV)$$

wherein $R_8$, $R_9$, T, n, y and X are as defined in general formula (III).

In one exemplary embodiment, T as defined in general formula (IV) is —C(═O)—O— or —O—C(═O)—.

Preferably, the average chain length of the alkyl or alkenyl group is at least $C_{14}$, more preferably at least $C_{16}$. Even more preferably at least half of the chains have a length of $C_{18}$. The fatty acid chains of the ester quat may comprise from 20 to 35 weight percent of saturated $C_{18}$ chains and from 20 to 35 weight percent of monounsaturated $C_{18}$ chains by weight of total fatty acid chains. Preferably, the ester quat is derived from palm or tallow feedstocks. These feedstocks may be pure or predominantly palm or tallow based. Blends of different feedstocks may be used. In one embodiment, the fatty acid chains of the ester quat comprise from 25 to 30 weight percent, preferably from 26 to 28 weight percent of saturated $C_{18}$ chains and from 25 to 30 weight percent, preferably from 26 to 28 weight percent of monounsaturated $C_{18}$ chains, by weight of total fatty acid chains. In another embodiment, the fatty acid chains of the ester quat comprise from 30 to 35 weight percent, preferably from 33 to 35 weight percent of saturated $C_{18}$ chains and from 24 to 35 weight percent, preferably from 27 to 32 weight percent of monounsaturated $C_{18}$ chains, by weight of total fatty acid chains. The alkyl or alkenyl chains may be predominantly linear, although a degree of branching, especially mid-chain branching, is within the scope of the invention.

In some aspects, the quat is triethanolamine-based quaternary ammonium of general formula (V):

$$[N^+(C_2H_4\text{—}OOCR_{11})_2(CH_3)(C_2H_4\text{—}OH)](CH_3)_zSO_4\text{—} \quad (V)$$

wherein $R_{11}$ is a $C_{12}$-$C_{20}$ alkyl group;

z is an integer from 1 to 3.

The quaternary ammonium compound of the present invention may also be a mixture of various quaternary ammonium compounds, notably for instance a mixture of mono-, di- and tri-ester components or a mixture of mono-, and di-ester components, wherein for instance the amount of diester quaternary is comprised between 30 and 99% by weight based on the total amount of the quaternary ammonium compound.

Preferably, the quaternary ammonium compound is a mixture of mono-, di- and tri-ester components, wherein:

- the amount of di-ester quaternary is comprised between 30 and 70% by weight based on the total amount of the quaternary ammonium compound, preferably between 40 and 60% by weight,
- the amount of mono-ester quaternary is comprised between 10 and 60% by weight based on the total amount of the quaternary ammonium compound, preferably between 20 and 50% by weight,
- the amount of tri-ester quaternary is comprised between 1 and 20% by weight based on the total amount of the quaternary ammonium compound.

Alternatively, the quaternary ammonium compound is a mixture of mono- and di-ester components, wherein:

- the amount of di-ester quaternary is comprised between 30 and 99% by weight based on the total amount of the quaternary ammonium compound, preferably between 50 and 99 by weight,
- the amount of mono-ester quaternary is comprised between 1 and 50% by weight based on the total amount of the quaternary ammonium compound, preferably between 1 and 20% by weight.

Preferred ester quaternary ammonium compounds of the present invention include:

TET: Di(tallowcarboxyethyl)hydroxyethyl methyl ammonium methylsulfate,

TEO: Di(oleocarboxyethyl)hydroxyethyl methyl ammonium methylsulfate,

TES: Distearyl hydroxyethyl methyl ammonium methylsulfate,

TEHT: Di(hydrogenated tallow-carboxyethyl)hydroxyethyl methyl ammonium methylsulfate, TEP: Di(palmiticcarboxyethyl)hydroxyethyl methyl ammonium methylsulfate, DEEDMAC: Dimethylbis[2-[(1-oxooctadecyl)oxy]ethyl] ammonium chloride.

In one exemplary embodiment, the quaternary ammonium compound is bis-(2-hydroxypropyl)-dimethylammonium methylsulphate fatty acid ester having a molar ratio of fatty acid moieties to amine moieties of from 1.5 to 1.99, an average chain length of the fatty acid moieties of from 16 to 18 carbon atoms and an iodine value of the fatty acid moieties, calculated for the free fatty acid, of from 0.5 to 60, and from 0.5 to 5% by weight fatty acid. Preferably, the bis-(2-hydroxypropyl)-dimethylammonium methylsulphate fatty acid ester is a mixture of at least one di-ester of formula:

$$[(CH_3)_2N^+(CH_2CH(CH_3)OC(=O)R_{12})_2]CH_3SO_4^- \quad (VI)$$

and at least one mono-ester of formula:

$$[(CH_3)_2N^+(CH_2CH(CH_3)OH)(CH_2CH(CH_3)OC(=O)R_{12})]CH_3SO_4^- \quad (VII)$$

wherein $R_{12}$ is the hydrocarbon group of a fatty acid moiety $R_{12}COO$—. Notably, such bis-(2-hydroxypropyl)-dimethylammonium methylsulphate fatty acid ester has a molar ratio of fatty acid moieties to amine moieties of from 1.85 to 1.99, the fatty acid moiety has an average chain length of from 16 to 18 carbon atoms and an iodine value, calculated for the free fatty acid, of from 0.5 to 60, preferably from 0.5 to 50. The average chain length is preferably from 16.5 to 17.8 carbon atoms. The iodine value is preferably from 5 to 40, more preferably, from 15 to 35. The iodine value is the amount of iodine in g consumed by the reaction of the double bonds of 100 g of fatty acid, which may notably be determined by the method of ISO 3961. In order to provide the required average chain length and iodine value, the fatty acid moiety may be derived from a mixture of fatty acids comprising both saturated and unsaturated fatty acids.

In another exemplary embodiment, the quaternary ammonium compound is a compound of the general formula:

(VIII)

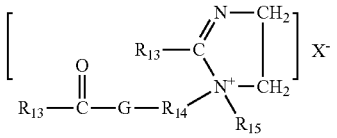

wherein $R_{15}$ is either hydrogen, a short chain $C_1$-$C_6$, preferably $C_1$-$C_3$ alkyl or hydroxyalkyl group, e.g. methyl, ethyl, propyl, hydroxyethyl, and the like, poly($C_2$-$C_3$ alkowy), preferably polyethoxy, benzyl, or mixtures thereof;

$R_{13}$ is a hydrocarbyl, or substituted hydrocarbyl group;

$X^-$ have the definitions given above;

$R_{14}$ is a $C_1$-$C_6$ alkylene group, preferably an ethylene group; and

G is an oxygen atom, or an —$NR_{10}$— group wherein $R_{10}$ is as defined above.

A non-limiting example of compound (VIII) is 1-methyl-1-stearoylamidoethyl-2-stearoylimidazolinium methylsulfate.

In still another exemplary embodiment, the quaternary ammonium compound is a compound of the general formula:

(IX)

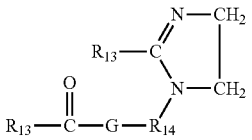

wherein $R_{13}$, $R_{14}$ and G are defined as above.

A non-limiting example of compound (IX) is I-tallowylamidoethyl-2-tallowylimidazoline.

In still another exemplary embodiment, the quaternary ammonium compound is a compound of the general formula:

(X)

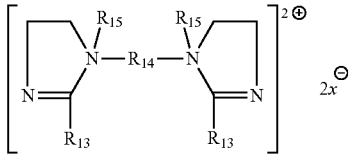

wherein $R_{13}$, $R_{14}$ and $R_{15}$ are defined as above.

A non-limiting example of compound (X) is (XI)

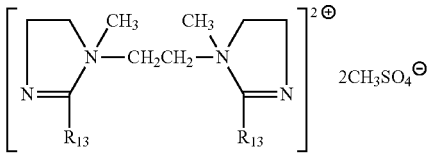

wherein $R_{13}$ is defined as above.

The quaternary ammonium compound may be present in an amount of from 0.5 to 45 wt % based on the total weight of the composition. Preferably, the quaternary ammonium compound is present in an amount of from 0.5 to 10 wt % based on the total weight of the composition. More preferably, the quaternary ammonium compound is present in an amount of from 2 to 8 wt % based on the total weight of the composition. Still more preferably, the quaternary ammonium compound is present in an amount of from 2.5 to 4.5 wt % based on the total weight of the composition.

Cationic Polysaccharide

According to the present invention, the composition comprises at least one cationic polysaccharide. The composition may also comprise a mixture of more than one cationic polysaccharides.

The cationic polysaccharide can be obtained by chemically modifying polysaccharides, generally natural polysaccharides. By such modification, cationic side groups can be introduced into the polysaccharide backbone. In one embodiment, the cationic groups borne by the cationic polysaccharide according to the present invention are quaternary ammonium groups.

The cationic polysaccharides of the present invention include but are not limited to:

cationic cellulose and derivatives thereof, cationic starch and derivatives thereof, cationic callose and derivatives thereof, cationic xylan and derivatives thereof, cationic mannan and derivatives thereof, cationic galactomannan and derivatives thereof, such as cationic guar and derivatives thereof.

Cationic celluloses suitable for the present invention include cellulose ethers comprising quaternary ammonium groups, cationic cellulose copolymers or celluloses grafted with a water-soluble quaternary ammonium monomer.

The cellulose ethers comprising quaternary ammonium groups are described in French patent 1,492,597 and in particular include the polymers sold under the names "JR" (JR 400, JR 125, JR 30M) or "LR" (LR 400, LR 30M) by the company Dow. These polymers are also defined in the CTFA dictionary as hydroxyethylcellulose quaternary ammoniums that have reacted with an epoxide substituted with a trimethylammonium group. Suitable cationic celluloses also include LR3000 KC from the company Solvay.

The cationic cellulose copolymers or the celluloses grafted with a water-soluble quaternary ammonium monomer are described especially in U.S. Pat. No. 4,131,576, such as hydroxyalkylcelluloses, for instance hydroxymethyl-, hydroxyethyl- or hydroxypropylcelluloses grafted especially with a methacryloyl-ethyltrimethylammonium, methacrylamidopropyltrimethylammonium or dimethyl-diallylammonium salt. The commercial products corresponding to this definition are more particularly the products sold under the names Celquat® L 200 and Celquat® H 100 by the company Akzo Nobel.

Cationic starches suitable for the present invention include the products sold under Polygelo® (cationic starches from Sigma), the products sold under Softgel®, Amylofax® and Solvitose® (cationic starches from Avebe), CATO from National Starch.

Suitable cationic galactomannans can be those derived from Fenugreek Gum, Konjac Gum, Tara Gum, Cassia Gum or Guar Gum.

In some aspects, the cationic polysaccharide is a cationic guar. Guars are polysaccharides composed of the sugars galactose and mannose. The backbone is a linear chain of β 1,4-linked mannose residues to which galactose residues are 1,6-linked at every second mannose in average, forming short side units. Within the context of the present invention, the cationic guars are cationic derivatives of guars.

In the case of the cationic polysaccharide, such as the cationic guar, the cationic group may be a quaternary ammonium group bearing 3 radicals, which may be identical or different, preferably chosen from hydrogen, alkyl, hydroxyalkyl, epoxyalkyl, alkenyl, or aryl, preferably containing 1 to 22 carbon atoms, more particularly 1 to 14 and advantageously 1 to 3 carbon atoms. The counterion is generally a halogen. One example of the halogen is chlorine.

Examples of the quaternary ammonium group include: 3-chloro-2-hydroxypropyl trimethyl ammonium chloride (CHPTMAC), 2,3-epoxypropyl trimethyl ammonium chloride (EPTAC), diallyldimethyl ammonium chloride (DMDAAC), vinylbenzene trimethyl ammonium chloride, trimethylammonium ethyl metacrylate chloride, methacrylamidopropyltrimethyl ammonium chloride (MAPTAC), and tetraalkylammonium chloride.

One example of the cationic functional group in the cationic polysaccharides, such as the cationic guars, is trimethylamino(2-hydroxyl)propyl, with a counter ion. Various counter ions can be utilized, including but not limited to halides, such as chloride, fluoride, bromide, and iodide, sulfate, notrate, methylsulfate, and mixtures thereof.

The cationic guars of the present invention may be chosen from the group consisting of:

cationic hydroxyalkyl guars, such as cationic hydroxyethyl guar, cationic hydroxypropyl guar, cationic hydroxybutyl guar, and cationic carboxylalkyl guars including cationic carboxymethyl guar, cationic alkylcarboxy guars such as cationic carboxylpropyl guar and cationic carboxybutyl guar, cationic carboxymethylhydroxypropyl guar.

In one exemplary embodiment, the cationic polysaccharide of the present invention is guar hydroxypropyltrimonium chloride or hydroxypropyl guar hydroxypropyltrimonium chloride.

The cationic polysaccharides, such as the cationic guars, of the present invention may have an average molecular weight (Mw) of between 100,000 Daltons and 3,500,000 Daltons, preferably between 100,000 Daltons and 1,500,000 Daltons.

The composition may comprise from 0.05 to 10 wt % of the cationic polysaccharide based on the total weight of the composition. Preferably, the composition comprises from 0.05 to 5 wt % of the cationic polysaccharide based on the total weight of the composition. More preferably, the composition comprises from 0.2 to 2 wt % of the cationic polysaccharide based on the total weight of the composition.

In the context of the present application, the term "Degree of Substitution (DS)" of cationic polysaccharides, such as cationic guars, is the average number of hydroxyl groups substituted per sugar unit. DS may notably represent the number of the carboxymethyl groups per sugar unit. DS may be determined by titration.

The DS of the cationic polysaccharide, such as the cationic guar, may be in the range of 0.01 to 1. Preferably, the DS of the cationic polysaccharide, such as the cationic guar, is in the range of 0.05 to 1. More preferably, the DS of the cationic polysaccharide, such as the cationic guar, is in the range of 0.05 to 0.2.

In the context of the present application, "Charge Density (CD)" of cationic polysaccharides, such as cationic guars, means the ratio of the number of positive charges on a monomeric unit of which a polymer is comprised to the molecular weight of said monomeric unit.

The CD of the cationic polysaccharide, such as the cationic guar, may be in the range of 0.1 to 3 (meq/gm). Preferably, the CD of the cationic polysaccharide, such as the cationic guar, is in the range of 0.1 to 2 (meq/gm). More preferably, the CD of the cationic polysaccharide, such as the cationic guar, is in the range of 0.1 to 1 (meq/gm).

First Non-Ionic Polysaccharide

The first non-ionic polysaccharide of the present invention can be a modified non-ionic polysaccharide or a non-modified non-ionic polysaccharide. The modified non-ionic polysaccharide may comprise hydroxyalkylation and/or esterification. In the context of the present application, the level of modification of non-ionic polysaccharides can be characterized by Molar Substitution (MS), which means the average number of moles of substituents, such as hydroxypropyl groups, per mole of the monosaccharide unit. MS can be determined by the Zeisel-GC method, notably based on the following literature reference: K. L. Hodges, W. E. Kester, D. L. Wiederrich, and J. A. Grover, "Determination of Alkoxyl Substitution in Cellulose Ethers by Zeisel-Gas Chromatography", Analytical Chemistry, Vol. 51, No. 13, November 1979. When using this method the following gas chromatograph conditions can be used:

Column: DB-1 (30 m×0.32 mm ID×1.0 μm film thickness),
Program: 75° C.-300° C. at 25° C./min (hold at 75° C. for 5 minutes),
Detector: Flame Ionization,
Injector/Detector Temperature: 250/320° C.,
Carrier gas Flow: Helium—1 ml/min,
Split flow: Helium—20 ml/min, and
Injection volume: 1 microliter.

The MS of the first non-ionic polysaccharide may be in the range of 0 to 3, preferably, in the range of 0.1 to 3.

The first non-ionic polysaccharide of the present invention may be especially chosen from glucans, modified or non-modified starches (such as those derived, for example, from cereals, for instance wheat, corn or rice, from vegetables, for instance yellow pea, and tubers, for instance potato or cassava), amylose, amylopectin, glycogen, dextrans, celluloses and derivatives thereof (methylcelluloses, hydroxyalkylcelluloses, ethylhydroxyethylcelluloses), mannans, xylans, lignins, arabans, galactans, galacturonans, chitin, chitosans, glucuronoxylans, arabinoxylans, xyloglucans, glucomannans, pectic acids and pectins, arabinogalactans, carrageenans, agars, gum arabics, gum tragacanths, ghatti gums, karaya gums, carob gums, galactomannans such as guars and non-ionic derivatives thereof (hydroxypropyl guar), and mixtures thereof.

Among the celluloses that are especially used are hydroxyethylcelluloses and hydroxypropylcelluloses. Mention may be made of the products sold under the names Klucel® EF, Klucel® H, Klucel® LHF, Klucel® MF and Klucel® G by the company Aqualon, and Cellosize® Polymer PCG-10 by the company Amerchol, and HEC, HPMC K200, HPMC K35M by the company Ashland.

In some aspects, the first non-ionic polysaccharide is a non-ionic guar, which can be modified or non-modified. The non-modified non-ionic guars include the products sold under the name Vidogum® GH 175 by the company Unipectine and under the names Meypro®-Guar 50 and Jaguar® C by the company Solvay. The modified non-ionic guars are especially modified with $C_1$-$C_6$ hydroxyalkyl groups. Among the hydroxyalkyl groups that may be mentioned, for example, are hydroxymethyl, hydroxyethyl, hydroxypropyl and hydroxybutyl groups. These guars are well known in the prior art and can be prepared, for example, by reacting the corresponding alkene oxides such as, for example, propylene oxides, with the guar so as to obtain a guar modified with hydroxypropyl groups.

The first non-ionic polysaccharide of the present invention may have an average molecular weight (Mw) of between 100,000 Daltons and 3,500,000 Daltons, preferably between 500,000 Daltons and 3,500,000 Daltons.

The composition may comprise from 0.05 to 10 wt % of the first non-ionic polysaccharide based on the total weight of the composition. Preferably, the composition comprises from 0.05 to 5 wt % of the first non-ionic polysaccharide based on the total weight of the composition. More preferably, the composition comprises from 0.2 to 2 wt % of the first non-ionic polysaccharide based on the total weight of the composition.

Second Non-Ionic Polysaccharide

According to the present invention, the composition comprises a second non-ionic polysaccharide wherein the second non-ionic polysaccharide is different from the first non-ionic polysaccharide. As used herein, the term "different" means that the second non-ionic polysaccharide has at least one characteristics which is different from that of the first non-ionic polysaccharide, such as average molecular weight, MS, structure of the molecule, nature of the substituents. The second non-ionic polysaccharide has a Molar Substitution (MS) in the range of 0.2 to 1.8, notably, the MS of the second non-ionic polysaccharide may be 0.2, 0.3, 0.4, 0.5, 0.6, 0.7, 0.8, 0.9, 1.0, 1.1, 1.2, 1.3, 1.4, 1.5, 1.6, 1.7, 1.8 or in any narrower numeric range that falls within the range of 0.2 to 1.8. Preferably, the second non-ionic polysaccharide has a MS in the range of from 0.2 to 1.2. More preferably, the second non-ionic polysaccharide has a MS in the range of from 0.4 to 1.0. The meaning of MS is as defined above.

In some embodiments, the second non-ionic polysaccharide has a MS in the range of from 0.5 to 1.8.

The second non-ionic polysaccharide of the present invention may have an average molecular weight (Mw) of between 100,000 Daltons and 3,500,000 Daltons. In particular, the second non-ionic polysaccharide has a relatively large average molecular weight. Preferably, the second non-ionic polysaccharide has an average molecular weight of between 1,000,000 Daltons and 3,000,000 Daltons. More preferably, the second non-ionic polysaccharide has an average molecular weight of between 1,500,000 Daltons and 3,000,000 Daltons.

The second non-ionic polysaccharide may be especially chosen from derivatives of glucans, starches, amylose, amylopectin, glycogen, dextrans, celluloses, mannans, xylans, lignins, arabans, galactans, galacturonans, chitin, chitosans, glucuronoxylans, arabinoxylans, xyloglucans, glucomannans, pectic acids and pectins, arabinogalactans, carrageenans, agars, gum arabics, gum tragacanths, ghatti gums, karaya gums, carob gums, galactomannans such as guars, and mixtures thereof.

Notably, the second non-ionic polysaccharide may be a hydroxyethylcellulose or a hydroxypropylcellulose.

In some aspects, the second non-ionic polysaccharide is a non-ionic guar. In particular, the second non-ionic polysaccharide is a non-ionic guar modified with $C_1$-$C_6$ hydroxyalkyl groups. Among the hydroxyalkyl groups that may be mentioned, for example, are hydroxymethyl, hydroxyethyl, hydroxypropyl and hydroxybutyl groups.

The composition may comprise from 0.01 to 5 wt % of the second non-ionic polysaccharide based on the total weight of the composition. Preferably, the composition comprises from 0.01 to 1 wt % of second non-ionic polysaccharide based on the total weight of the composition. More preferably, the composition comprises from 0.05 to 0.5 wt % of the second non-ionic polysaccharide based on the total weight of the composition.

The ratio between the weight of the quaternary ammonium compound and the total weight of the polysaccharides comprised in the composition may be between 2:1 and 100:1, more preferably, between 5:1 and 30:1.

The ratio between the weight of the cationic polysaccharide and the total weight of the non-ionic polysaccharides comprised in the composition may be between 1:10 and 10:1, more preferably, between 1:3 and 3:1.

When talking about fabric conditioning compositions, it is highly desirable that the compositions can impart fabrics, aside from softness and other conditioning benefits, pleasant odour. This will require the compositions to contain a fragrance material or perfume in an amount sufficient for imparting the odour to the fabrics after the treatment. In addition, it is highly desired that the fragrance material or perfume can be effectively deposited onto the fabrics and the odour provided by them can be of high intensity and be long lasting on the fabrics. According to one aspect of the present invention, the composition of the present invention may further comprise a fragrance material or perfume. It has been found that such composition exhibits improved fragrance/perfume performance compared to conventional compositions. Without wishing to be bound by theory, it is believed that those beneficial effects may be attributed to the synergistic effect of the cationic polysaccharide, the non-ionic polysaccharides and the quaternary ammonium compound, which enhances the deposition of the fragrance material or the perfume on a substrate, in particular, on a fabric, extending gradually the release of the fragrance material or perfume, enhancing the fragrance or perfume longevity (substantivity). As a result, the odour of the fragrance material or perfume can remain substantive for an extended time period on the substrate, in particular, the fabric, after the rinsing and drying (line or machine drying) steps.

As used herein, the term "fragrance material or perfume" means any organic substance or composition which has a desired olfactory property and is essentially non-toxic. Such substances or compositions include all fragrance material and perfumes that are commonly used in perfumery or in household compositions (laundry detergents, fabric conditioning compositions, soaps, all-purpose cleaners, bathroom cleaners, floor cleaners) or personal care compositions. The compounds involved may be natural, semi-synthetic or synthetic in origin.

Preferred fragrance materials and perfumes may be assigned to the classes of substance comprising the hydrocarbons, aldehydes or esters. The fragrances and perfumes also include natural extracts and/or essences, which may comprise complex mixtures of constituents, i.e. fruits such as almond, apple, cherry, grape, pear, pineapple, orange, lemon, strawberry, raspberry and the like; musk, flower scents such as lavender, jasmine, lily, magnolia, rose, iris, carnation and the like; herbal scents such as rosemary, thyme, sage and the like; woodland scents such as pine, spruce, cedar and the like.

Non limitative examples of synthetic and semi-synthetic fragrance materials and perfumes are:
7-acetyl-1,2,3,4,5,6,7,8-octahydro-1,1,6,7-tetramethylnaphthalene, α-ionone, β-ionone, γ-ionone, α-isomethylionone, methylcedrylone, methyl dihydrojasmonate, methyl 1,6,10-trimethyl-2,5,9-cyclododecatrien-1-yl ketone, 7-acetyl-1,1,3,4,4,6-hexamethyltetralin, 4-acetyl-6-tert-butyl-1,1-dimethylindane, hydroxyphenylbutanone, benzophenone, methyl b-naphthyl ketone, 6-acetyl-1,1,2,3,3,5-hexamethylindane, 5-acetyl-3-isopropyl-1,1,2-,6-tetramethylindane, 1-dodecanal, 4-(4-hydroxy-4-methylpentyl)-3-cyclohexene-1-carboxaldehyde, 7-hydroxy-3,7-dimethyloctanal, 10-undecen-1-al, isohexenylcyclohexylcarboxaldehyde, formyltricyclodecane, condensation products of hydroxycitronellal and methyl anthranilate, condensation products of hydroxycitronellal and indole, condensation products of phenylacetaldehyde and indole, 2-methyl-3-(para-tert-butylphenyl)propionaldehyde, ethylvanillin, heliotropin, hexylcinnamaldehyde, amylcinnamaldehyde, 2-methyl-2-(isopropylphenyl)propionaldehyde, coumarin, γ-decalactone, cyclopentadecanolide, 16-hydroxy-9-hexadecenoic acid lactone, 1,3,4,6,7,8-hexahydro-4,6,6,7,8,8-hexamethylcyclopenta-g-benzopyran, β-naphthol methyl ether, ambroxane, dodecahydro-3a,6,6,9a-tetramethylnaphtho[2,1b]furan, cedrol, 5-(2,2,3-trimethylcyclopent-3-enyl)-3-methylpentan-2-ol, 2-ethyl-4-(2,2,3-trimethyl-3-cyclopenten-1-yl)-2-buten-1-ol, caryophyllene alcohol, tricyclodecenyl propionate, tricyclodecenyl acetate, benzyl salicylate, cedryl acetate, and tert-butylcyclohexyl acetate.

Particular preference is given to the following:
hexylcinnamaldehyde, 2-methyl-3-(tert-butylphenyl)propionaldehyde, 7-acetyl-1,2,3,4,5,6,7,8-octahydro-1,1,6,7-tetramethylnaphthalene, benzyl salicylate, 7-acetyl-1,1,3,4,4,6-hexamethyltetralin, para-tert-butylcyclohexyl acetate, methyl dihydrojasmonate, (β-naphthol methyl ether, methyl g-naphthyl ketone, 2-methyl-2-(para-isopropylphenyl)propionaldehyde, 1,3,4,6,7,8-hexahydro-4,6,6,7,8,8-hexamethylcyclopenta-g-2-benzopyran, dodecahydro-3a,6,6,9a-tetramethylnaphtho[2,1b]furan, anisaldehyde, coumarin, cedrol, vanillin, cyclopentadecanolide, tricyclodecenyl acetate and tricyclodecenyl propionates.

Other fragrance materials and perfumes are essential oils, resinoids and resins from a large number of sources, such as, Peru balsam, olibanum resinoid, styrax, labdanum resin, nutmeg, cassia oil, benzoin resin, coriander, clary sage, eucalyptus, geranium, lavender, mace extract, neroli, nutmeg, spearmint, sweet violet leaf, valerian and lavandin.

Some or all of the fragrance materials and perfumes may be encapsulated, typical perfume components which it is advantageous to encapsulate, include those with a relatively low boiling point. It is also advantageous to encapsulate perfume components which have a low C log P (i.e. those which will be partitioned into water), preferably with a C log P of less than 3.0. As used herein, the term "C log P" means the calculated logarithm to base 10 of the octanol/water partition coefficient (P).

Further suitable fragrance materials and perfumes include: phenylethyl alcohol, terpineol, linalool, linalyl acetate, geraniol, nerol, 2-(1,1-dimethylethyl)cyclo-hexanol acetate, benzyl acetate, and eugenol.

The fragrance material or perfume can be used as single substance or in a mixture with one another.

Perfumes frequently include solvents or diluents, for example: ethanol, isopropanol, diethylene glycol monoethyl ether, dipropylene glycol, diethyl phthalate and triethyl citrate.

The composition may comprise from 0.01 to 10 wt % of the fragrance material or perfume based on the total weight of the composition. Preferably, the composition comprises from 0.1 to 5 wt % of the fragrance material or perfume based on the total weight of the composition. More preferably, the composition comprises from 0.3 to 5 wt % of the fragrance material or perfume based on the total weight of the composition.

Accordingly, in another aspect of the present invention, there is provided a method for enhancing fragrance or perfume longevity of a composition by adding to the composition (a) a quaternary ammonium compound; (b) a cationic polysaccharide; (c) a first non-ionic polysaccharide; (d) a second non-ionic polysaccharide; and (e) a fragrance material or perfume, wherein the second non-ionic polysaccharide is different from the first non-ionic polysaccharide and the second non-ionic polysaccharide has a molar substitution (MS) in the range of 0.2 to 1.8. Preferably, the cationic polysaccharide is a cationic guar. More preferably, the cationic polysaccharide is a cationic guar and the first non-ionic polysaccharide is a non-ionic guar.

The composition may further comprise one or more of the following optional ingredients: dispersing agents, stabilizers, rheology modifying agent, pH control agents, colorants, brighteners, fatty alcohols, fatty acids, dyes, odor control agent, pro-perfumes, cyclodextrins, solvents, preservatives, chlorine scavengers, anti-shrinkage agents, fabric crisping agents, spotting agents, anti-oxidants, anti-corrosion agents, bodying agents, drape and form control agents, smoothness agents, static control agents, wrinkle control agents, sanitization agents, disinfecting agents, germ control agents, mold control agents, mildew control agents, antiviral agents, anti-microbials, drying agents, stain resistance agents, soil release agents, malodor control agents, fabric refreshing agents, chlorine bleach odor control agents, dye fixatives, dye transfer inhibitors, color maintenance agents, color restoration/rejuvenation agents, anti-fading agents, whiteness enhancers, anti-abrasion agents, wear resistance agents, fabric integrity agents, anti-wear agents, defoamers and anti-foaming agents, rinse aids, UV protection agents, sun fade inhibitors, insect repellents, anti-allergenic agents, enzymes, flame retardants, water proofing agents, fabric comfort agents, water conditioning agents, stretch resistance agents, and mixtures thereof. Such optional ingredients may be added to the composition in any desired order.

In referring to optional ingredients, without this having to be regarded as an exhaustive description of all possibilities, which, on the other hand, are well known to the person skilled in the art, the following may be mentioned:

other products that enhance the softening performance of the composition, such as silicones, amine oxides, anionic surfactants, such as lauryl ether sulphate or lauryl sulphate, sulphosuccinates, amphoteric surfactants, such as amphoacetate, nonionic surfactants such as polysorbate, polyglucoside derivatives, and cationic polymers such as polyquaternium, etc.;

stabilising products, such as salts of amines having a short chain, which are quaternised or non-quaternised, for example of triethanolamine, N-methyldiethanolamine, etc., and also non-ionic surfactants, such as ethoxylated fatty alcohols, ethoxylated fatty amines, polysorbate, and ethoxylated alkyl phenols; typically used at a level of from 0 to 15% by weight of the composition;

products that improve viscosity control, which is preferably added when the composition comprises high concentrations of fabric conditioning active (such as the quaternary ammonium compound); for example inorganic salts, such as calcium chloride, magnesium chloride, calcium sulphate, sodium chloride, etc.; products which can be used improve the stability in concentrated compositions, such as compounds of the glycol type, such as, glycerol, polyglycerols, ethylene glycol, polyethylene glycols, dipropylene glycol, other polyglycols, etc.; and thickening agents for diluted compositions, for example, acrylamide based polymers (e.g. Flosoft 222 from SNF company), hydrophobically-modified ethoxylated urethanes (e.g. Acusol 880 from Dow company);

components for adjusting the pH, which is preferably from 2 to 8, such as any type of inorganic and/or organic acid, for example hydrochloric, sulphuric, phosphoric, citric acid etc.;

agents that improve soil release, such as the known polymers or copolymers based on terephthalates;

bactericidal preservative agents;

other products such as antioxidants, colouring agents, perfumes, germicides, fungicides, anti-corrosive agents, anti-crease agents, opacifiers, optical brighteners, pearl lustre agents, etc.

The composition may comprise a silicone compound. The silicone compound of the invention can be a linear or branched structured silicone polymer. The silicone of the present invention can be a single polymer or a mixture of polymers. Suitable silicone compounds include polyalkyl silicone, amonosilicone, siloxane, polydimethyl siloxane, ethoxylated organosilicone, propoxylated organosilicone, ethoxylated/propoxylated organosilicone and mixture thereof. Suitable silicones include but are not limited to those available from Wacker Chemical, such as Wacker® FC 201 and Wacker® FC 205.

The composition may comprise a cross-linking agent. Following is a non-restrictive list of cross-linking agents: methylene bisacrylamide (MBA), ethylene glycol diacrylate, polyethylene glycol dimethacrylate, diacrylamide, triallylamine, cyanomethylacrylate, vinyl oxyethylacrylate or methacrylate and formaldehyde, glyoxal, compounds of the glycidyl ether type such as ethyleneglycol diglycidyl ether, or the epoxydes or any other means familiar to the expert permitting cross-linking.

The composition may comprise at least one surfactant system. A variety of surfactants can be used in the composition of the invention, including cationic, nonionic and/or amphoteric surfactants, which are commercially available from a number of sources. For a discussion of surfactants, see Kirk-Othmer, Encyclopedia of Chemical Technology, Third Edition, volume 8, pages 900-912. Preferably, the composition comprises a surfactant system in an amount effective to provide a desired level of softness to fabrics, preferably between about 5 and about 10 wt %. For example, the composition may comprise a non-ionic surfactant which is an alkoxylated compound. The nonionic surfactant may comprise an average of from 2 to 100 moles of alkylene oxide per mole of the nonionic surfactant. This is referred to herein as the alkoxylation number (of the nonionic surfactant). Suitable nonionic surfactants include addition products of ethylene oxide and/or propylene oxide with fatty alcohols, fatty acids, fatty amines and fatty oils.

The composition may comprise a dye, such as an acid dye, a hydrophobic dye, a basic dye, a reactive dye, a dye conjugate. Suitable acid dyes include azine dyes such as acid blue 98, acid violet 50, and acid blue 59, non-azine acid dyes such as acid violet 17, acid black 1 and acid blue 29. Hydrophobic dyes selected from benzodifuranes, methine, triphenylmethanes, napthalimides, pyrazole, napthoquinone, anthraquinone and mono-azo or di-azo dye chromophores. Suitable hydrophobic dyes are those dyes which do not contain any charged water solubilising group. The hydrophobic dyes may be selected from the groups of disperse and solvent dyes. Blue and violet anthraquinone and mono-azo dye are preferred. Basic dyes are organic dyes which carry a net positive charge. They deposit onto cotton. They are of particular utility for used in composition that contain predominantly cationic surfactants. Dyes may be selected from the basic violet and basic blue dyes listed in the Colour Index International. Preferred examples include triarylmethane basic dyes, methane basic dye, anthraquinone basic dyes, basic blue 16, basic blue 65, basic blue 66, basic blue 67, basic blue 71, basic blue 159, basic violet 19, basic violet 35, basic violet 38, basic violet 48; basic blue 3, basic blue 75, basic blue 95, basic blue 122, basic blue 124, basic blue 141. Reactive dyes are dyes which contain an organic group capable of reacting with cellulose and linking the dye to cellulose with a covalent bond. Preferably the reactive group is hydrolysed or reactive group of the dyes has been reacted with an organic species such as a polymer, so as to the link the dye to this species. Dyes may be selected from the reactive violet and reactive blue dyes listed in the Colour Index International. Preferred examples include reactive blue 19, reactive blue 163, reactive blue 182 and reactive blue, reactive blue 96. Dye conjugates are formed by binding direct, acid or basic dyes to polymers or particles via physical forces. Dependent on the choice of polymer or particle they deposit on cotton or synthetics. A description is given in WO2006/055787. Particularly preferred dyes are: direct violet 7, direct violet 9, direct violet 11, direct violet 26, direct violet 31, direct violet 35, direct violet 40, direct violet 41, direct violet 51, direct violet 99, acid blue 98, acid violet 50, acid blue 59, acid violet 17, acid black 1, acid blue 29, solvent violet 13, disperse violet 27 disperse violet 26, disperse violet 28, disperse violet 63, disperse violet 77 and mixtures thereof.

The composition may comprise an antimicrobial. The antimicrobial may be a halogenated material. Suitable halogenated materials include 5-chloro-2-(2,4-dichlorophenoxy) phenol, o-Benzyl-p-chloro-phenol, and 4-chloro-3-methylphenol. Alternatively The antimicrobial may be a non-halogenated material. Suitable non-halogenated materials include 2-Phenylphenol and 2-(1-Hydroxy-1-methylethyl)-5-methylcyclohexanol. Phenyl ethers are one preferred subset of the antimicrobials. The antimicrobial may also be a bi-halogenated compound. Most preferably this comprises 4-4' dichloro-2-hydroxy diphenyl ether, and/or 2,2-dibromo-3-nitrilopropionamide (DBNPA).

The composition may also comprise preservatives. Preferably only those preservatives that have no, or only slight, skin sensitizing potential are used. Examples are phenoxy ethanol, 3-iodo-2-propynylbutyl carbamate, sodium N-(hydroxymethyl)glycinate, biphenyl-2-ol as well as mixtures thereof.

The composition may also comprise antioxidants to prevent undesirable changes caused by oxygen and other oxidative processes to the solid composition and/or to the treated textile fabrics. This class of compounds includes, for example, substituted phenols, hydroquinones, pyrocatechols, aromatic amines and vitamin E.

The composition may comprise a hydrophobic agent. The hydrophobic agent may be present in an amount of from 0.05 to 1.0 wt %, preferably from 0.1 to 0.8 wt %, more preferably from 0.2 to 0.7 and most preferably from 0.4 to 0.7 wt % by weight of the total composition, for example from 0.2 to 0.5 wt %. The hydrophobic agent may have a C log P of from 4 to 9, preferably from 4 to 7, most preferably from 5 to 7.

Suitable hydrophobic agents include esters derived from the reaction of a fatty acid with an alcohol. The fatty acid preferably has a carbon chain length of from $C_8$ to $C_{22}$ and may be saturated or unsaturated, preferably saturated. Some examples include stearic acid, palmitic acid, lauric acid and myristic acid. The alcohol may be linear, branched or cyclic. Linear or branched alcohols have a preferred carbon chain length of from 1 to 6. Preferred alcohols include methanol, ethanol, propanol, isopropanol, sorbitol. Preferred hydrophobic agents include methyl esters, ethyl esters, propyl esters, isopropyl esters and sorbitan esters derived from such fatty acids and alcohols.

Non-limiting examples of suitable hydrophobic agents include methyl esters derived from fatty acids having a carbon chain length of from at least $C_{10}$, ethyl esters derived from fatty acids having a carbon chain length of from at least $C_{10}$, propyl esters derived from fatty acids having a carbon chain length of from at least $C_8$, isopropyl esters derived from fatty acids having a carbon chain length of from at least $C_8$, sorbitan esters derived from fatty acids having a carbon chain length of from at least $C_{16}$, and alcohols with a carbon chain length greater than $C_{10}$. Naturally occurring fatty acids commonly have a carbon chain length of up to $C_{22}$.

Some preferred materials include methyl undecanoate, ethyl decanoate, propyl octanoate, isopropyl myristate, sorbitan stearate and 2-methyl undecanol, ethyl myristate, methyl myristate, methyl laurate, isopropyl palmitate and ethyl stearate; more preferably methyl undecanoate, ethyl decanoate, isopropyl myristate, sorbitan stearate, 2-methyl undecanol, ethyl myristate, methyl myristate, methyl laurate and isopropyl palmitate.

Non-limiting examples of such materials include methyl undecanoate, ethyl decanoate, propyl octanoate, isopropyl myristate, sorbitan stearate and 2-methyl undecanol; preferably methyl undecanoate, ethyl decanoate, isopropyl myristate, sorbitan stearate and 2-methyl undecanol.

The composition may comprise an antifoam agent. The antifoam agent may be present in an amount of from 0.025 to 0.45 wt %, preferably 0.03 to 0.4 wt %, most preferably from 0.05 to 0.35 wt %, for example 0.07 to 0.4 wt %, by weight of the total composition and based on 100 percent antifoam activity. A wide variety of materials may be used as the antifoam agent, and antifoam agents are well known to those skilled in the art. See, for example, Kirk Othmer Encyclopedia of Chemical Technology, Third Edition, Volume 7, pages 430-447 (John Wiley and Sons, Inc., 1979).

Suitable antifoam agents include, for example, silicone antifoam compounds, alcohol antifoam compounds, for example 2-alkyl alcanol antifoam compounds, fatty acids, paraffin antifoam compounds, and mixtures thereof. By antifoam compound it is meant herein any compound or mixtures of compounds which act such as to depress the foaming or sudsing produced by a solution of a detergent composition, particularly in the presence of agitation of that solution.

Particularly preferred antifoam agents for use herein are silicone antifoam compounds defined herein as any antifoam compound including a silicone component. Many such silicone antifoam compounds also contain a silica component. The term "silicone" as used herein, and in general throughout the industry, encompasses a variety of relatively high molecular weight polymers containing siloxane units and hydrocarbyl group of various types like the polyorganosiloxane oils, such as polydimethyl-siloxane, dispersions or emulsions of polyorganosiloxane oils or resins, and combinations of polyorganosiloxane with silica particles wherein the polyorganosiloxane is chemisorbed or fused onto the silica. Silica particles are often hydrophobed, e.g. as Trimethylsiloxysilicate. Silicone antifoam agents are well known in the art and are, for example, disclosed in U.S. Pat. No. 4,265,779, issued May 5, 25 1981 and European Patent Application No. 89307851.9, published Feb. 7, 1990. Other silicone antifoam compounds are disclosed in U.S. Pat. No. 3,455,839. Silicone defoamers and suds controlling agents in granular detergent compositions are disclosed in U.S. Pat. No. 3,933,672, 35 and in U.S. Pat. No. 4,652,392 issued Mar. 24, 1987. Examples of suitable silicone antifoam compounds are the combinations of polyorganosiloxane with silica particles commercially available from Dow Corning, Wacker Chemie and Momentive.

Other suitable antifoam compounds include the monocarboxylic fatty acids and soluble salts thereof. These materials are described in U.S. Pat. No. 2,954,347. The monocarboxylic fatty acids, and salts thereof, for use as antifoam agents typically have hydrocarbyl chains of about 10 to about 24 carbon atoms, preferably about 12 to about 18 carbon atoms like the tallow amphopolycarboxyglycinate commercially available under the trade name TAPAC. Suitable salts include the alkali metal salts such as sodium, potassium, and lithium salts, and ammonium and alkanolammonium salts.

Other suitable antifoam compounds include, for example, high molecular weight hydrocarbons such as paraffin, light petroleum odourless hydrocarbons, fatty esters (e. g. fatty acid triglycerides, glyceryl derivatives, polysorbates), fatty acid esters of monovalent alcohols, aliphatic $C_{18-40}$ ketones (e. g. stearone)N-alkylated amino triazines such as tri- to hexa-10 alkylmelamines or di- to tetra alkyldiamine chlortriazines formed as products of cyanuric chloride with two or three moles of a primary or secondary amine containing 1 to 24 carbon atoms, propylene oxide, bis stearic acid amide and monostearyl phosphates such as monostearyl alcohol phosphate ester and monostearyl di-alkali metal (e. g., K, Na, and Li) phosphates and phosphate esters, and nonionic polyhydroxyl derivatives. The hydrocarbons, such as paraffin and 15 haloparaffin, can be utilized in liquid form. The liquid hydrocarbons will be liquid at room temperature and atmospheric pressure, and will have a pour point in the range of about −40° C. and about 5° C., and a minimum boiling point not less than about 110° C. (atmospheric pressure). It is also known to utilize waxy hydrocarbons, preferably having a melting point below about 100° C. Hydrocarbon suds suppressers are described, for example, in U.S. Pat. No. 4,265,779. The hydrocarbons, thus, include aliphatic, alicyclic, aromatic, and heterocyclic saturated or unsaturated hydrocarbons having from about 12 to about 70 carbon atoms. The term "paraffin", as used in this suds suppresser discussion, is intended to include mixtures of true paraffins and cyclic hydrocarbons. Copolymers of ethylene oxide and propylene oxide, particularly the mixed ethoxylated/propoxylated fatty alcohols with an alkyl chain length of from about 10 to about 16 carbon atoms, a degree of ethoxylation of from about 3 to about 30 and a degree of propoxylation of from about 1 to about 10, are also suitable antifoam compounds for use herein.

Other antifoam agents useful herein comprise the secondary alcohols (e.g., 2-alkyl alkanols as described in DE 40 21 265) and mixtures of such alcohols with silicone oils, such as the silicones disclosed in U.S. Pat. No. 4,798,679 and EP 150,872. The secondary alcohols include the $C_6$-$C_{16}$ alkyl alcohols having a $C_1$-$C_{16}$ chain like the 2-Hexyldecanol commercially available under the trade name ISOFOL16, 2-Octyldodecanol commercially available under the tradename ISOFOL20, and 2-butyl octanol, which is available under the trademark ISOFOL 12 from Condea. A preferred alcohol is 2-butyl octanol, which is available from Condea under the trademark ISOFOL 12. Mixtures of secondary alcohols are available under the trademark ISALCHEM 123 from Enichem. Mixed antifoam agents typically comprise mixtures of alcohol to silicone at a weight ratio of about 1:5 to about 5:1. Further preferred antifoam agents are Silicone SRE grades and Silicone SE 47M, SE39, SE2, SE9 and SE10 available from Wacker Chemie; BF20+, DB310, DC1410, DC1430, 22210, HV495 and Q2-1607 ex Dow Corning; FD20P and BC2600 supplied by Basildon; and SAG 730 ex Momentive. Other suitable antifoams, described in the literature such as in Hand Book of Food Additives, ISBN 0-566-07592-X, p. 804, are selected from dimethicone, poloxamer, polypropyleneglycol, tallow derivatives, and mixtures thereof.

Preferred among the antifoam agents described above are the silicone antifoams agents, in particular the combinations of polyorganosiloxane with silica particles.

The composition may comprise an antifreeze agent. The antifreeze agent as described below is used to improve freeze recovery of the composition.

The antifreeze active may be an alkoxylated non-ionic surfactant having an average alkoxylation value of from 4 to 22, preferably from 5 to 20 and most preferably from 6 to 20. The alkoxylated non-ionic surfactant may have a C log P of from 3 to 6, preferably from 3.5 to 5.5. Mixtures of such nonionic surfactants may be used.

Suitable non-ionic surfactants which can be used as the antifreeze agent include in particular the reaction products of compounds having a hydrophobic group and a reactive hydrogen atom, for example aliphatic alcohols, acids, or alkyl phenols with alkylene oxides, preferably ethylene oxide either alone or with propylene oxide.

Suitable antifreeze agents may also be selected from alcohols, diols and esters. A particularly preferred additional antifreeze agent is monopropylene glycol (MPG). Other non-ionic antifreeze materials, which are outside the scope of the non-ionic antifreeze component of the present invention but which may be additionally included in the compositions of the invention include alkyl polyglycosides, ethoxylated castor oils, and sorbitan esters.

Further suitable antifreeze agents are those disclosed in EP 0018039 including paraffins, long chain alcohols and several esters for example glycerol mono stearate, iso butyl stearate and iso propyl palmitate. Also materials disclosed in U.S. Pat. No. 6,063,754 such as $C_{10-12}$ isoparaffins, isopropyl myristate and dioctyladapate.

The composition may comprise a stabilizer. The stabilizer may be a mixture of a water-insoluble, cationic material and a non-ionic material selected from hydrocarbons, fatty acids, fatty esters and fatty alcohols.

The composition may comprise a floc prevention agent, which may be a non-ionic alkoxylated material having an HLB value of from 8 to 18, preferably from 11 to 16, more preferably from 12 to 16 and most preferably 16. The non-ionic alkoxylated material can be linear or branched, preferably linear. Suitable floc prevention agents include non-ionic surfactants. Suitable non-ionic surfactants include addition products of ethylene oxide and/or propylene oxide with fatty alcohols, fatty acids and fatty amines. The floc prevention agent is preferably selected from addition products of (a) an alkoxide selected from ethylene oxide, propylene oxide and mixtures thereof with (b) a fatty material selected from fatty alcohols, fatty acids and fatty amines.

The composition may comprise a polymeric thickening agent. Suitable polymeric thickening agents are water soluble or dispersable. Monomers of the polymeric thickening agent may be non-ionic, anionic or cationic. Following is a non-restrictive list of monomers performing a nonionic function: acrylamide, methacrylamide, N-Alkyl acrylamide, N-vinyl pyrrolidone, N-vinyl formamide, N-vinyl acetamide, vinylacetate, vinyl alcohol, acrylate esters, allyl alcohol. Following is a non-restrictive list of monomers performing an anionic function: acrylic acid, methacrylic acid, itaconic acid, crotonic acid, maleic acid, fumaric acid, as well as monomers performing a sulfonic acid or phosphonic acid functions, such as 2-acrylamido-2-methyl propane sulfonic acid (ATBS) etc. The monomers may also contain hydrophobic groups. Suitable cationic monomers are selected from the group consisting of the following monomers and derivatives and their quaternary or acid salts: dimethylaminopropylmethacrylamide, dimethylaminopropylacrylamide, diallylamine, methyldiallylamine, dialkylaminoalkyl-acrylates and methacrylates, dialkylaminoalkyl-acrylamides or -methacrylamides.

Polymeric thickening agents particularly useful in the composition of the invention include those described in WO2010/078959. These are crosslinked water swellable cationic copolymers having at least one cationic monomer and optionally other nonionic and/or anionic monomers. Preferred polymers of this type are copolymers of acrylamide and trimethylaminoethylacrylate chloride.

Preferred polymers comprise less than 25 percent of water soluble polymers by weight of the total polymer, preferably less than 20 percent, and most preferably less than 15 percent, and a cross-linking agent concentration of from 500 ppm to 5000 ppm relative to the polymer, preferably from 750 ppm to 5000 ppm, more preferably from 1000 to 4500 ppm (as determined by a suitable metering method such as that described on page 8 of patent EP 343840). The cross-linking agent concentration must be higher than about 500 ppm relative to the polymer, and preferably higher than about 750 ppm when the crosslinking agent used is the methylene bisacrylamide, or other cross-linking agents at concentrations that lead to equivalent cross-linking levels of from 10 to 10,000 ppm.

The composition of the present invention may optionally contain an oily sugar derivative. An oily sugar derivative is a liquid or soft solid derivative of a cyclic polyol (CPE) or of a reduced saccharide (RSE), said derivative resulting from 35 to 100% of the hydroxyl groups in said polyol or in said saccharide being esterified or etherified. The derivative has two or more ester or ether groups independently attached to a $C_8$-$C_{22}$ alkyl or alkenyl chain.

Advantageously, the CPE or RSE does not have any substantial crystalline character at 20° C. Instead it is preferably in a liquid or soft solid state as herein defined at 20° C.

The liquid or soft solid (as hereinafter defined) CPEs or RSEs suitable for use in the present invention result from 35 to 100% of the hydroxyl groups of the starting cyclic polyol or reduced saccharide being esterified or etherified with groups such that the CPEs or RSEs are in the required liquid or soft solid state. These groups typically contain unsaturation, branching or mixed chain lengths.

Typically the CPEs or RSEs have 3 or more ester or ether groups or mixtures thereof, for example 3 to 8, especially 3 to 5. It is preferred if two or more of the ester or ether groups of the CPE or RSE are independently of one another attached to a $C_8$ to $C_{22}$ alkyl or alkenyl chain. The $C_8$ to $C_{22}$ alkyl or alkenyl groups may be branched or linear carbon chains.

Preferably 35 to 85% of the hydroxyl groups, most preferably 40-80%, even more preferably 45-75%, such as 45-70% are esterified or etherified.

Preferably the CPE or RSE contains at least 35% tri or higher esters, e.g. at least 40%.

The CPE or RSE has at least one of the chains independently attached to the ester or ether groups having at least one unsaturated bond. This provides a cost effective way of making the CPE or RSE a liquid or a soft solid. It is preferred if predominantly unsaturated fatty chains, derived from, for example, rape oil, cotton seed oil, soybean oil, oleic, tallow, palmitoleic, linoleic, erucic or other sources of unsaturated vegetable fatty acids, are attached to the ester/ether groups.

These chains are referred to below as the ester or ether chains (of the CPE or RSE).

The ester or ether chains of the CPE or RSE are preferably predominantly unsaturated. Preferred CPEs or RSEs include sucrose tetratallowate, sucrose tetrarapeate, sucrose tetraoleate, sucrose tetraesters of soybean oil or cotton seed oil, cellobiose tetraoleate, sucrose trioleate, sucrose triapeate, sucrose pentaoleate, sucrose pentarapeate, sucrose hexaoleate, sucrose hexarapeate, sucrose triesters, pentaesters and hexaesters of soybean oil or cotton seed oil, glucose tiroleate, glucose tetraoleate, xylose trioleate, or sucrose tetra-, tri-, penta- or hexa-esters with any mixture of predominantly unsaturated fatty acid chains. The most preferred CPEs or RSEs are those with monounsaturated fatty acid chains, i.e. where any polyunsaturation has been removed by partial hydrogenation. However some CPEs or RSEs based on polyunsaturated fatty acid chains, e.g. sucrose tetralinoleate, may be used provided most of the polyunsaturation has been removed by partial hydrogenation.

The most highly preferred liquid CPEs or RSEs are any of the above but where the polyunsaturation has been removed through partial hydrogenation. Preferably 40% or more of the fatty acid chains contain an unsaturated bond, more preferably 50% or more, most preferably 60% or more. In most cases 65% to 100%, e.g. 65% to 95% contain an unsaturated bond.

CPEs are preferred for use with the present invention. Inositol is a preferred example of a cyclic polyol. Inositol derivatives are especially preferred.

In the context of the present invention, the term cyclic polyol encompasses all forms of saccharides. Indeed saccharides are especially preferred for use with this invention. Examples of preferred saccharides for the CPEs or RSEs to be derived from are monosaccharides and disaccharides.

Examples of monosaccharides include xylose, arabinose, galactose, fructose, sorbose and glucose. Glucose is especially preferred. Examples of disaccharides include maltose, lactose, cellobiose and sucrose. Sucrose is especially preferred. An example of a reduced saccharide is sorbitan.

The liquid or soft solid CPEs can be prepared by methods well known to those skilled in the art. These include acylation of the cyclic polyol or reduced saccharide with an acid chloride; trans-esterification of the cyclic polyol or reduced saccharide fatty acid esters using a variety of catalysts; acylation of the cyclic polyol or reduced saccharide with an acid anhydride and acylation of the cyclic polyol or reduced saccharide with a fatty acid. See for instance U.S. Pat. No. 4,386,213 and AU 14416/88 (both P&G).

It is preferred if the CPE or RSE has 3 or more, preferably 4 or more ester or ether groups. If the CPE is a disaccharide it is preferred if the disaccharide has 3 or more ester or ether groups. Particularly preferred CPEs are esters with a degree of esterification of 3 to 5, for example, sucrose tri, tetra and penta esters.

Where the cyclic polyol is a reducing sugar it is advantageous if each ring of the CPE has one ether or ester group, preferably at the $C_1$ position. Suitable examples of such compounds include methyl glucose derivatives.

Examples of suitable CPEs include esters of alkyl(poly) glucosides, in particular alkyl glucoside esters having a degree of polymerisation from 1 to 2.

The length of the unsaturated (and saturated if present) chains in the CPE or RSE is $C_8$-$C_{22}$, preferably $C_{12}$-$C_{22}$. It is possible to include one or more chains of $C_1$-$C_8$, however these are less preferred.

The liquid or soft solid CPEs or RSEs which are suitable for use in the present invention are characterised as materials having a solid:liquid ratio of between 50:50 and 0:100 at 20° C. as determined by $T_2$ relaxation time NMR, preferably between 43:57 and 0:100, most preferably between 40:60 and 0:100, such as, 20:80 and 0:100. The $T_2$ NMR relaxation time is commonly used for characterising solid:liquid ratios in soft solid products such as fats and margarines. For the purpose of the present invention, any component of the signal with a $T_2$ of less than 100 μs is considered to be a solid component and any component with $T_2 \geq 100$ μs is considered to be a liquid component.

For the CPEs and RSEs, the prefixes (e.g. tetra and penta) only indicate the average degrees of esterification. The compounds exist as a mixture of materials ranging from the monoester to the fully esterified ester. It is the average degree of esterification which is used herein to define the CPEs and RSEs.

The HLB of the CPE or RSE is typically between 1 and 3.

Where present, the CPE or RSE is preferably present in the composition in an amount of 0.5-50% by weight, based upon the total weight of the composition, more preferably 1-30% by weight, such as 2-25%, e.g. 2-20%.

The CPEs and RSEs for use in the compositions of the invention include sucrose tetraoleate, sucrose pentaerucate, sucrose tetraerucate and sucrose pentaoleate.

Preferably, the composition of the present invention is substantially free or completely free of any silicone containing quaternary ammonium compounds. In the context of the present application, "substantially free" when used with reference to the absence of silicone containing quaternary ammonium compounds in the composition, means that the composition comprises less than 0.1 wt % of the silicone containing quaternary ammonium compounds, more preferably less than 0.01 wt % of the silicone containing quaternary ammonium compounds, based on the total weight of the composition. As used herein, the term "completely free" when used with reference to the absence of the silicone containing quaternary ammonium compounds in the composition, means that the composition comprises no silicone containing quaternary ammonium compounds at all.

The composition of the present invention may be prepared by any mixing means known by a person skilled in the art. Preferably, the cationic polysaccharide, the first non-ionic polysaccharide and the second non-ionic polysaccharide are premixed prior to addition to the composition. Alternatively, they can be added separately to the composition.

For example, the composition may be prepared by the following procedure:

(i) providing an aqueous dispersion of a mixture of the cationic polysaccharide, the first non-ionic polysaccharide and the second non-ionic polysaccharide. Optionally, other additives may also be added in the aqueous dispersion. Preferably, agitation and/or heating are provided to facilitate the process. In one preferred embodiment, the pH value of the aqueous dispersion of the polysaccharides is adjusted to be in the range of 3.5 to 5 by using an acidic agent;

(ii) mixing the quaternary ammonium compound with the aqueous dispersion obtained in (i), to give rise to the composition of the present invention. Preferably, the quaternary ammonium compound is melt by heating before the mixing. Agitation and heating can also be provided to facilitate the process.

Preferably, the pH value of the composition obtained in (ii) is adjusted to be in the range of 2.5 to 8, by using a suitable acidic agent or basic agent. Optional additives may also be added to the composition at this stage.

The composition of the present invention may take a variety of physical forms including solid (such as granule), liquid, liquid-gel, paste-like, foam in either aqueous or non-aqueous form, and any other suitable form known by a person skilled in the art. For better dispersibility, a preferred form of the composition is a liquid form, and preferably in the form of an aqueous dispersion in water. When in a liquid form, the composition may also be dispensed with dispensing means such as a sprayer or aerosol dispenser.

In some aspects, the composition of the present invention is a liquid fabric conditioning composition. When in the liquid form, the composition may contain from 0.1% to 20% by weight of a fabric conditioning agent, in the case of standard (diluted) fabric softener but may contain higher levels from up to 30% or even 40% by weight in the case of very concentrated fabric conditioning compositions. The composition usually also contains a liquid carrier and other additives, which may provide the balance of the composition. Suitable liquid carriers are selected from water, organic solvents and mixtures thereof. The liquid carrier employed in the composition is preferably water due to its low cost, safety, and environmental compatibility. Mixtures of water and organic solvent may be used. Preferred organic solvents are; monohydric alcohol, such as ethanol, propanol, isopropanol or butanol; dihydric alcohol, such as glycol; trihydric alcohols, such as glycerol, and polyhydric (polyol) alcohols.

According to one aspect of the present invention, there is provided a composition comprising (a) from 0.5 wt % to 10 wt % of a quaternary ammonium compound; (b) from 0.05 wt % to 10 wt % of a cationic polysaccharide; (c) from 0.05 wt % to 10 wt % of a first non-ionic polysaccharide; (d) from 0.01 wt % to 5 wt % of a second non-ionic polysaccharide and (f) a liquid carrier, wherein the second non-ionic polysaccharide is different from the first non-ionic polysaccharide and the second non-ionic polysaccharide has a Molar Substitution (MS) in the range of 0.2 to 1.8; weight percentages are based on the total weight of the composition.

Notably, there is provided a composition comprising (a) from 2 wt % to 8 wt % of a quaternary ammonium compound; (b) from 0.05 wt % to 5 wt % of a cationic polysaccharide; (c) from 0.05 wt % to 5 wt % of a first non-ionic polysaccharide; (d) from 0.01 wt % to 1 wt % of a second non-ionic polysaccharide and (f) a liquid carrier, wherein the second non-ionic polysaccharide is different from the first non-ionic polysaccharide and the second non-ionic polysaccharide has a Molar Substitution (MS) in the range of 0.2 to 1.8; weight percentages are based on the total weight of the composition.

In another aspect, the present invention also concerns the use of the composition according to the present invention as a textile care agent.

In still another aspect, the present invention also provides a method for conditioning a fabric by using the composition of the present invention. The method notably comprises the step of contacting an aqueous medium containing the composition of the present invention with the fabric.

The composition of the present invention can be used in a so-called rinse process. Typically the fabric conditioning composition of the present invention is added during the rinse cycle of an automatic laundry machine (such as an automatic fabric washing machine).

When being used in the rinse process, the composition is first diluted in an aqueous rinse bath solution. Subsequently, the laundered fabrics which have been washed with a detergent liquor and optionally rinsed in a first inefficient rinse step ("inefficient" in the sense that residual detergent and/or soil may be carried over with the fabrics), are placed in the rinse solution with the diluted composition. Of course, the composition may also be incorporated into the aqueous bath once the fabrics have been immersed therein. Following that step, agitation is applied to the fabrics in the rinse bath solution causing the suds to collapse, and residual soils and surfactant is to be removed. The fabrics can then be optionally wrung before drying.

The present invention notably relates to method of using the composition described herein in a first rinse scenario. It has been surprisingly found that the composition of the present invention can provide excellent softening effects even in the presence of laundry residues, notably anionic surfactants, which are carried over from the washing step to the rinse solution. A rinsing process by using said composition does not require any additional rinsing of the fabrics for eliminating the laundry residues before the fabrics are contacted with said composition. This is particularly advantageous as the method allows reduced water consumption and shortened time for the laundry operation.

When being used in the first rinse, said composition may be first diluted in a rinse solution, subsequently the fabrics may be immersed in the rinse solution. Alternatively, the fabrics may be first immersed in a rinse solution, such as clear water, and subsequently said composition is added into the rinse solution.

Accordingly, the present invention provides a method for rinsing fabrics, said method comprising the step of contacting the fabrics, previously laundered with a detergent composition, with the composition described herein; wherein the fabrics are contacted with said composition in a first rinse.

The present invention further provides a method for reducing water consumption in a laundry operation in which a fabric conditioning composition is utilized, said method comprising the steps of: (1) washing fabrics with a detergent composition; (2) removing a major portion of the detergent composition; and (3) rinsing the fabrics in a first rinse in which the fabrics are contacted with the composition described herein.

Said detergent composition may be any compositions suitable for cleaning fabrics, and may be in the form of solid (such as granule and powder) or liquid. The detergent composition comprises at least a surfactant system. The detergent composition may also comprise detergent builders, metal ions, lipids, enzymes, bleaching agents and perfumes. The surfactant system may comprise anionic, non-ionic, cationic, and amphoteric or zwitterionic surfactants, or combinations thereof. The detergent composition notably comprises at least an anionic surfactant. The anionic surfactants include alkyl ether sulphates, soaps, fatty acid ester sulphonates, alkyl benzene sulphonates, sulphosuccinate esters, primary alkyl sulphates, olefin sulphonates, paraffin sulphonates and organic phosphate. Preferred anionic surfactants are the alkali and alkaline earth metal salts of fatty acid carboxylates, fatty alcohol sulphates, preferably primary alkyl sulfates, more preferably they are ethoxylated, for example alkyl ether sulphates; alkylbenzene sulphonates, alkyl ester fatty acid sulphonates, especially methyl ester fatty acid sulphonates and mixtures thereof.

The composition, when being used in the first rinse in which the rinse solution contains considerable amount of laundry residues, can provide superior softening effects compared to conventional fabric conditioning compositions. Without wishing to be bound by theory, it is believed that the superior softening effects of the composition are attributed to less interaction with the laundry residues, notably the anionic surfactants. The composition is particularly advantageous compared to conventional fabric conditioning composition when they are used in conjunction with high dosage detergent which is added in the washing step.

According to the method of the present invention, the first rinse may be a rinse cycle in an automated or non-automated washing machine. The washing machine can either be front loaded or top loaded. When being used in such process, the composition as described herein may be first diluted in a rinse solution. Subsequently the fabrics that have been laundered in the washing cycle and span may be, without additional rinsing of the fabrics, directly immersed in the rinse solution with the diluted composition. The composition may also be dispersed into the rinse solution once the laundered fabrics have been immersed therein. Following that step, agitation may be applied to the fabrics in the rinse solution. The fabrics may then be optionally wrung before drying.

Alternatively, the firs rinse may be a hand rinsing process, which can be performed in a container, such as a basin or bucket. When hand rinsing is performed, the laundered fabrics are removed from the detergent liquor and wrung out. The composition described herein may be added to fresh water and the fabrics are then directly rinsed in the rinse solution water containing the composition according to the conventional rinsing habit. The fabrics may be subsequently dried according to conventional means.

In still another aspect of the present invention, there is provided a recipient containing the composition of the present invention. The recipient allows easy transportation of the composition, and distribution of the composition to users as well. The recipient of the present invention may be a tank, a bottle, a box, a tube, or the like. The recipient may be made of various materials, including and not being limited to plastic, rubber, metal, synthetic fiber, glass, ceramic material, wood and paper based material. The recipient may be in any shape which is easy for handling and transportation, including and not being limited to cubic, cuboidal, cylindrical, conical and irregular shape. The recipient preferably has at least one opening for the composition to be filled in or taken out. Preferably, the opening is on a top of the recipient. The recipient may also have a cover for closing the opening. The cover may be a lid, a cap such as a threaded cap, a sealing, a plug, a spigot, or the like.

Should the disclosure of any patents, patent applications, and publications which are incorporated herein by reference conflict with the description of the present application to the extent that it may render a term unclear, the present description shall take precedence.

EXAMPLES

Materials

Quat: Di(palmiticcarboxyethyl)hydroxyethyl methyl ammonium methylsulfate; Fentacare® TEP softener (from Solvay);

Cationic Polysaccharide 1: a guar hydroxypropyltrimonium chloride having an average molecular weight of below 1,500,000 Daltons;

Non-ionic Polysaccharide 1: a hydroxypropyl guar having an average molecular weight of between 1,500,000 and 2,500,000 Daltons and a MS of between 0.9 and 1.6;

Non-ionic Polysaccharide 2: a hydroxypropyl guar having an average molecular weight of between 2,000,000 and 3,000,000 Daltons and a MS of between 0.5 and 0.85;

Non-ionic Polysaccharide 3: a hydroxypropyl guar having an average molecular weight of between 2,000,000 and 3,000,000 Daltons and a MS of approximately 0.4;

Non-ionic Polysaccharide 4: *Cyamopsis Tetragonoloba* (guar) Gum having an average molecular weight of between 2,000,000 and 3,000,000 Daltons and a MS of 0;

Perfume 1: an oil perfume;

Perfume 2: an encapsulated perfume;

Detergent: Breeze® Powder Power Clean (by Unilever).

Procedures for Sample Preparation

1. One or more polysaccharide and water were added into a first beaker, then heated up to 55° C. with stirring.
2. TEP was melt in a second beaker at 55° C. and then added into the first beaker, then the mixture was agitated for at least 5 mins.
3. The mixture of step (2) was cooled down to 35° C. and the perfumes were added into the mixture.
4. The pH value of the mixture was adjusted to target value with 10 wt % NaOH water solution.

Example 1: Softening Performance Test

Sample compositions were prepared according to the formulations shown in Table 1 below:

TABLE 1

| Components | Sample 1 | Comparative Sample 1 |
|---|---|---|
| Quat (active, wt %) | 4 | 4 |
| Cationic Polysaccharide 1 (wt %) | 0.2 | 0.6 |
| Non-ionic Polysaccharide 1 (wt %) | 0.2 | |
| Non-ionic Polysaccharide 2 (wt %) | 0.2 | |
| Perfume 1 (wt %) | 1 | 1 |

TABLE 1-continued

| Components | Sample 1 | Comparative Sample 1 |
|---|---|---|
| Perfume 2 (wt %) | 1 | 1 |
| Water (wt %) | Balance | Balance |
| Total (wt %) | 100 | 100 |

For the softening performance test, 2 grams of each of the samples were diluted in 1 liter water. Then towels were immersed into the water containing different samples (5 towels for each sample), respectively, for 10 mins. Then, the treated towels were drawn out, span for 5 mins and dried overnight. Then, the softness of each treated towel was evaluated by five panellists independently in which the panellist touched the treated towel and felt the softness of the treated towel (double-blinded test). The softness of the treated towels was rated in a scale of 1 to 5, wherein 1 represents the lowest softness and 5 represents the highest softness. Subsequently, the average softness rating of the towels treated by the same sample (n=25) was calculated. The results are shown in Table 2 below:

TABLE 2

| | Sample 1 | Comparative Sample 1 |
|---|---|---|
| Average softness rating | 4.2 | 3.9 |

It can be seen from Table 2 that the composition according to the present invention exhibited enhanced softening performance compared to that comprising cationic polysaccharide alone and comprising no non-ionic polysaccharides.

Example 2: Perfume Delivery Test

Sample compositions were prepared according to the formulations shown in Table 1 by using the above mentioned procedure.

For the perfume longevity test, 2 grams of each of the samples were diluted in 1 liter water. Then towels were immersed into the water containing different samples (one towel for each sample), respectively, for 10 mins. Then, the treated towels were drawn out and wring dried. Then the strength of the odour of each treated towel was immediately rated by 10 panellists independently (double-blinded test). The strength of the odour of the treated towels was rated in a scale of 1 to 5, wherein 1 represents the weakest odour and 5 represents the strongest odour. Subsequently, the average odour strength rating of the towels treated by the same sample (n=10) was calculated. The results are shown in Table 3 below:

TABLE 3

| | Sample 1 | Comparative Sample 1 |
|---|---|---|
| Average odour strength rating | 4.4 | 4.2 |

It can be seen from Table 3 that the towels treated by the composition according to the present invention showed stronger odour compared to those treated with compositions comprising cationic polysaccharide alone and comprising no non-ionic polysaccharides.

Example 3: Stability Test

Sample compositions were prepared according to the formulations in Table 4 below:

TABLE 4

| Components | Sample 2 | Comparative Sample 2 | Comparative Sample 3 |
|---|---|---|---|
| Quat (active, wt %) | 4 | 4 | 4 |
| Cationic Polysaccharide 1 (wt %) | 0.2 | 0.2 | 0.2 |
| Non-ionic Polysaccharide 1 (wt %) | 0.2 | 0.2 | — |
| Non-ionic Polysaccharide 2 (wt %) | 0.2 | — | — |
| Non-ionic Polysaccharide 3 (wt %) | — | — | 0.2 |
| Non-ionic Polysaccharide 4 (wt %) | — | — | 0.2 |
| Water (wt %) | Balance | Balance | Balance |
| Total (wt %) | 100 | 100 | 100 |

The sample compositions were prepared according to the procedure as described above. Then the samples were incubated in an oven at 40° C. and 50° C., respectively. The samples were taken out and cooled down to room temperature once observation or test is needed. The samples were observed every two weeks and the time points when phase segregation occurred in the samples were recorded. The results are shown in Table 5 below:

TABLE 5

| | Sample 2 | Comparative Sample 2 | Comparative Sample 3 |
|---|---|---|---|
| Stability at 40° C. | 14 weeks | 12 weeks | 12 weeks |
| Stability at 50° C. | 8 weeks | 6 weeks | 4 weeks |

According to the results, the composition according to the present invention (Sample 2) remained stable and homogenous until 14 weeks after incubation at 40° C. and until 8 weeks after incubation at 50° C. On the other hand, the composition which does not comprise the second non-ionic polysaccharide according to the present invention (Comparative Sample 2) remained stable and homogenous until only 12 weeks after incubation at 40° C. and until only 6 weeks after incubation at 50° C., indicating lower stability. Furthermore, the composition which comprises a non-ionic guar having a MS of 0.4 and a naive guar (Comparative Sample 3) exhibited lower stability compared to Sample 2.

Examples 4-9: Softening Performance in Presence of Carry-Over Residues

Fabric conditioning compositions were prepared according to the formulations shown in Table 6 below and according to the procedures described above.

TABLE 6

| Components | Sample 3 | Comparative Sample 4 | Comparative Sample 5 |
|---|---|---|---|
| Quat (active, wt %) | 6 | 6 | 10.5 |
| Cationic Polysaccharide 1 (wt %) | 0.2 | — | — |
| Non-ionic Polysaccharide 1 (wt %) | 0.2 | — | — |
| Non-ionic Polysaccharide 2 (wt %) | 0.1 | — | — |
| Water (wt %) | Balance | Balance | Balance |
| Total (wt %) | 100 | 100 | 100 |

Example 4

Three groups of towels (25 towels in each group) were, respectively, laundered in a Samsung top load washing machine (Model no. WA90F5S9) according to pre-set programs. The towels were subject to a wash cycle, followed by one rinse cycle (One Rinse Group), two rinse cycles (Two Rinse Group) and three rinse cycles (Three Rinse Group), respectively:

Wash cycle: washing for 21 mins (in 47 L water); draining and spinning for 10 mins;

Rinse cycle: rinsing for 12 mins (in 47 L water); draining and spinning for 13 mins.

For each group, the detergent (35 g) was added in the wash cycle. The fabric conditioning composition according to Sample 3 (47 g) was added in the last rinse cycle for each testing group (there was only one rinse cycle for the One Rinse group and the fabric conditioning composition was added in this rinse cycle).

The towels were collected after the last rinse cycle and dried in a humidity room overnight. Then the towels were subject to softness evaluation according to the procedures described above.

Example 5

The procedures are same as those in Example 4 except that the fabric conditioning composition according to Comparative Sample 4 (47 g) was added in the last rinse cycle for each group.

Example 6

The procedures are same as those in Example 4 except that the fabric conditioning composition according to Comparative Sample 5 (47 g) was added in the last rinse cycle for each group.

The results are shown in Table 7 below:

TABLE 7

| | Example 4 | Example 5 | Example 6 |
|---|---|---|---|
| | Average Softness Rating | | |
| One Rinse | 3.95 | 3.41 | 3.73 |
| Two Rinse | 4.16 | 3.77 | 4.26 |
| Three Rinse | 4.38 | 3.72 | 4.52 |

As shown in Table 7, Sample 3 provided superior softening effect compared to Comparative Samples 4 and 5 when they were added in the first rinse in presence of carry-over residues. When used in the first rinse, Sample 3 led to 16% higher softness compared to Comparative Sample 4.

Example 7

The procedures are same as those in Example 4 except that a higher dosage of the detergent (70 g) was added in the wash cycle.

Example 8

The procedures are same as those in Example 7 except that the fabric conditioning composition according to Comparative Sample 4 (47 g) was added in the last rinse cycle for each testing group.

Example 9

The procedures are same as those in Example 7 except that the fabric conditioning composition according to Comparative Sample 5 (47 g) was added in the last rinse cycle for each testing group.

The softness evaluation results are shown in Table 8 below:

TABLE 8

| | Example 7 | Example 8 | Example 9 |
|---|---|---|---|
| | Average Softness Rating | | |
| One Rinse | 4.29 | 3.22 | 3.23 |
| Two Rinse | 4.03 | 3.46 | 3.53 |
| Three Rinse | 4.33 | 3.74 | 4.28 |

As shown in Table 8, Sample 3 led to the best softening effects among all the formulations tested, no matter the fabric conditioning compositions were added in the first rinse cycle, the second rinse cycle or in the third rinse cycle. The fabric conditioning compositions containing quat alone (Comparative Samples 4 and 5) led to unfavourable softening effects when high dosage detergent was used in the washing step. These results demonstrate that the inventive composition is particularly suitable for use as a fabric conditioning composition where high detergent dosage is used in the washing step.

It is worth noting that when used in the first rinse and wherein the dosage of the detergent was 70 g, Sample 3 led to 33% higher softness compared to Comparative Sample 4. The differentiated softening effects between Sample 3 and Comparative Sample 4 was more evident when a higher dosage (70 g) of detergent was added in the washing step compared to the case wherein 35 g of detergent were added.

The invention claimed is:

1. A composition comprising (a) a quaternary ammonium compound; (b) a cationic polysaccharide; (c) a first non-ionic polysaccharide; and (d) a second non-ionic polysaccharide, wherein the second non-ionic polysaccharide is different from the first non-ionic polysaccharide and the second non-ionic polysaccharide has a Molar Substitution (MS) in the range of 0.2 to 1.8.

2. The composition according to claim 1, wherein the quaternary ammonium compound has the general formula:

$$[N+(R1)(R2)(R3)(R4)]yX— \quad (I)$$

wherein:

$R_1$, $R_2$, $R_3$ and $R_4$, which may be the same or different, is a C1-C30 hydrocarbon group, respectively;

X is an anion; and y is the valence of X.

3. The composition according to claim 2, wherein at least one of R1, R2, R3 and R4 as defined in general formula (I) contains an ester or amide group.

4. The composition according to claim 1, wherein the quaternary ammonium compound has the general formula:

$$[N+((CH2)n\text{-}T\text{-}R_8)m(R_9)4-m]yX— \quad (III)$$

wherein:

R8 is independently selected from C1-C24 alkyl or alkenyl group;

R9 is independently selected from C1-C4 alkyl or hydroxylalkyl group;

T is —C(═O)—O—, —O—C(═O)—, —NR10-C(═O)— or —(C═O)—NR10-, wherein R10 is hydrogen, a C1-C6 alkyl, or a C1-C6 hydroxyalkyl group;

n is an integer from 0 to 5;
m is selected from 1, 2 and 3;
X is an anion; and
y is the valence of X.

5. The composition according to claim 1, wherein the quaternary ammonium compound has the general formula:

$$[N+((CH2)n\text{-}T\text{-}R8)2(R9)2]yX— \quad (IV)$$

wherein $R_8$ is independently selected from $C_1$-$C_{24}$ alkyl or alkenyl group;
$R_9$ is independently selected from $C_1$-$C_4$ alkyl or hydroxylalkyl group;
T is —C(═O)—O—, —O—C(═O)—, —NR10-C(═O)— or —(C═O)—NR10-, wherein R10 is hydrogen, a C1-C6 alkyl, or a C1-C6 hydroxyalkyl group;
n is an integer from 0 to 5;
X is an anion; and
y is the valence of X.

6. The composition according to claim 1, wherein the quaternary ammonium compound is selected from the group consisting of:
TET: Di(tallowcarboxyethyl)hydroxyethyl methyl ammonium methylsulfate,
TEO: Di(oleocarboxyethyl)hydroxyethyl methyl ammonium methylsulfate,
TES: Distearyl hydroxyethyl methyl ammonium methylsulfate,
TEHT: Di(hydrogenated tallow-carboxyethyl)hydroxyethyl methyl ammonium methylsulfate,
TEP: Di(palmiticcarboxyethyl)hydroxyethyl methyl ammonium methylsulfate, and
DEEDMAC: Dimethylbis[2-[(1-oxooctadecyl)oxy]ethyl] ammonium chloride.

7. The composition according to claim 1, wherein the cationic polysaccharide is a cationic guar.

8. The composition according to claim 1, wherein the first non-ionic polysaccharide is a non-ionic guar.

9. The composition according to claim 1, wherein the second non-ionic polysaccharide has a MS in the range of 0.4 to 1.0.

10. The composition according to claim 1, wherein the second non-ionic polysaccharide has a MS in the range of 0.5 to 1.8.

11. The composition according to claim 1, wherein the second non-ionic polysaccharide has an average molecular weight of between 1,500,000 Daltons and 3,000,000 Daltons.

12. The composition according to claim 1, wherein the ratio between the weight of the quaternary ammonium compound and the total weight of the polysaccharides comprised in the composition is between 2:1 and 100:1.

13. The composition according to claim 1, wherein the quaternary ammonium compound is present in an amount of from 2 to 8 wt. % based on the total weight of the composition.

14. The composition according to claim 1, wherein the quaternary ammonium compound is present in an amount of from 2.5 to 4.5 wt. % based on the total weight of the composition.

15. The composition according to claim 1, wherein the composition further comprises a fragrance material or perfume.

16. The composition according to claim 15, wherein the composition comprises from 0.3 to 5 wt. % of the fragrance material or perfume based on the total weight of the composition.

17. The composition according to claim 1, wherein the composition comprises (a) from 0.5 wt. % to 10 wt. % of the quaternary ammonium compound; (b) from 0.05 wt. % to 10 wt. % of the cationic polysaccharide; (c) from 0.05 wt. % to 10 wt. % of the first non-ionic polysaccharide; (d) from 0.01 wt. % to 5 wt. % of the second non-ionic polysaccharide, and wherein the composition further comprises (f) a liquid carrier, the weight percentages are based on the total weight of the composition.

18. The composition according to claim 1, wherein the composition is a fabric conditioning composition.

19. A method for conditioning a fabric, the method comprising dispersing the composition according to claim 1 in water to form an aqueous dispersion.

20. The method according to claim 19, wherein the method further comprises the step of contacting the aqueous dispersion with a fabric.

21. A method for enhancing fragrance or perfume longevity of a composition by adding to the composition (a) a quaternary ammonium compound; (b) a cationic polysaccharide; (c) a first non-ionic polysaccharide; (d) a second non-ionic polysaccharide; and (e) a fragrance material or perfume, wherein the second non-ionic polysaccharide is different from the first non-ionic polysaccharide and the second non-ionic polysaccharide has a Molar Substitution (MS) in the range of 0.2 to 1.8.

22. A method for rinsing fabrics, said method comprising the step of contacting the fabrics, previously laundered with a detergent composition, with the composition according to claim 1; wherein the fabrics are contacted with said composition in a first rinse.

23. A method for reducing water consumption in a laundry operation in which the laundry operation comprises a fabric conditioning composition, said method comprising the steps of:
(1) washing fabrics with a detergent composition;
(2) removing a major portion of the detergent composition; and
(3) rinsing the fabrics in a first rinse in which the fabrics are contacted with the composition according to claim 1.

* * * * *